United States Patent [19]

Barata

[11] Patent Number: 4,585,404

[45] Date of Patent: Apr. 29, 1986

[54] DOUBLE-ECCENTRIC ROTARY APPARATUS WITH MINIMAL CHAMBER VOLUME

[75] Inventor: José M. B. Barata, Barcelona, Spain

[73] Assignee: Nidra Holding S.A., Luxembourg, Luxembourg

[21] Appl. No.: 724,136

[22] Filed: Apr. 17, 1985

[30] Foreign Application Priority Data

Jul. 21, 1984 [ES] Spain ..... 534541

[51] Int. Cl.[4] ..... F01C 1/00; F01C 17/06

[52] U.S. Cl. ..... 418/61 R; 418/138; 418/151

[58] Field of Search ..... 418/61 R, 138, 151; 123/242, 243

[56] References Cited

U.S. PATENT DOCUMENTS

| | | | |
|---|---|---|---|
| 3,200,796 | 8/1965 | Kraic et al. | 418/61 R |
| 3,511,584 | 5/1970 | Vierling | 418/61 R |
| 4,314,533 | 2/1982 | Barata et al. | 418/61 R |

FOREIGN PATENT DOCUMENTS

| | | | |
|---|---|---|---|
| 2349247 | 4/1974 | Fed. Rep. of Germany | 418/61 R |

*Primary Examiner*—John J. Vrablik

*Attorney, Agent, or Firm*—Flynn, Thiel, Boutell & Tanis

[57] ABSTRACT

A rotary apparatus wherein a rotor is movable within a cylindrical housing. The rotor is formed by a cylinder-like drum with projecting radial vanes. The drum is supported by a crank mechanism which includes a first crank eccentrically rotatable about a first crankshaft, and a second crank eccentrically rotatable about a second crankshaft, the second crankshaft being rotatable about the first crank. The drum is disposed with its central axis aligned with and rotatably supported on the second crank. The drum mounts thereon three axially projecting pins which define the corners of an equilateral triangle which has its center intersected by the axis of the drum. The pins cooperate with four control forks which are fixed relative to the cylindrical housing and project radially inwardly. The control forks define radially inwardly opening slots which are disposed for intermittent engagement with the pins to control the radial displacement of the pins, and hence the rotation of the rotor, so that the axis of the drum defines a four-pointed star-shaped hypocycloidal path as the rotor undergoes its combined orbital and rotational movement within the cylindrical housing.

16 Claims, 37 Drawing Figures

DOUBLE-ECCENTRIC ROTARY APPARATUS WITH MINIMAL CHAMBER VOLUME

FIELD OF THE INVENTION

The present invention relates to improvements in rotative pneumatic machines of the type which, with only three blades or vanes, perform twelve complete cycles of intake and expulsion for each complete rotation of the drum, or four complete cycles for each rotation of the output shaft.

BACKGROUND OF THE INVENTION

The known machine of this type comprises a static cylinder provided with two lateral walls, at least one of which is provided with a central opening to accommodate the central neck or hub which projects coaxially from at least one end of the drum. The drum presents an essentially cylindrical shape and is subject to two motions; one of rotation on its own geometric axis, and the other which describes an orbit in the inside of the static cylinder. The drum is provided with angularly spaced slots which extend axially along its periphery and which serve to permit the exit of the blades or vanes which project toward the outside. The vanes converge and are articulated by means of rings, in the manner of a hinge, around a common shaft located inside the drum. The shaft remains in a position wherein its axis is parallel to but radially spaced from the geometric axis of the drum, the shaft axis being aligned with the geometric center or axis of the static cylinder. The vanes thus are radii of the static cylinder and are fitted, at their radially outer ends, with sliding devices for engagement with the internal wall of the cylinder. The axial ends of the vanes also have sliding devices for engagement with the lateral walls of the cylinder. The vanes are supported on the drum by swivel joints which permit the vanes to radially slide inside the drum and which in addition let them vary their relative angles among themselves. The swivel joints are essentially cylindrical segments which, by their flat sides, engage the vanes and by their cylindrical sides engage the axial cuts or openings of the drum. The drum itself has a cylindrical concave profile for engagement with the swivel joints so that it is possible for them to perform an oscillating circular motion relative to the drum. The drum is assembled on one or more eccentrics which act as a crank arm, said eccentrics being drivingly coupled to the motor or driving shaft which exits from the machine so that each rotation of said shaft causes the drum to perform a complete circular orbit. The drum is rigidly fitted, on the central coaxial hub thereof, with a cylindrical pinion which, as it moves through its orbit, meshingly engages the internal teeth of a ring gear located in the same radial plane as the pinion. The ring gear is static and it is concentrically affixed relative to the cylinder so that it imparts to the drum, by its engaging the pinion, a motion of rotation about the drum's own geometric axis in a direction which is opposite its orbiting motion and therefore opposite the rotation of the motor shaft. The pinion and ring gear have a 3 to 1 engaging relationship so that for each three rotations executed by the motor or drive shaft, the drum will perform one rotation in the opposite direction.

With respect to these known motors, pumps and compressors which provide twelve complete cycles per rotation of the rotor, and specifically those machines fitted with only three vanes, reference is made to the hereinafter cited patents which are thought to be the most representative: Spanish Pat. No. 432,981; Spanish Pat. No. 432,982.

Although they relate to internal combustion engines which perform six cycles for each rotation of the rotor, the following patents are also cited since the new developments of this invention are compared thereto in the following description: French Pat. No. 2,201,715; U.S. Pat. No. 4,314,533.

In the class of engines, compressors and pumps described above, when there is formed a minimum chamber, as defined by one of the sectors of the drum between two vanes and the inside wall of the cylinder, said minimum chamber still has an appreciable residual volume since the drum rotates on its own axis at the same time as it orbits in a circular manner around the geometric axis of the static cylinder. But, in order for the drum to be able to rotate without sticking or binding against the cylinder, it is indispensible that the distance from any point on the periphery of the drum to its center of rotation be, as a maximum, the magnitude of the radius of the static cylinder less the magnitude of the radius of the eccentric or crank. If the vanes are fitted with cylindrical ring sectors on their heads, it is also necessary to deduct from the radius of the cylinder the thickness of these ring sectors.

As a consequence of the structure as explained above, the chambers as defined by the difference between the volume of the static cylinder and that of the drum with its elements, will be of minimum volume when the drum is cylindrical in shape which, as stated above, will have its radius equal to the static cylinder radius minus the value of the eccentricity. Since the radius of the drum is smaller than the radius of the static cylinder, in order to make the minimum chamber as small as possible, it is necessary to place the drum as close as possible to the internal wall of the cylinder until the cylinder wall is tangent to the middle point of the arc of the drum located between two vanes. As the radius of the drum is less than that of the cylinder, there thus remains on opposite sides of that tangency point two residual chambers which are limited by the vanes.

One of the important objects of the present invention is that of eliminating these two residual chambers which have been described above, by means of a system of mechanisms particular to this invention, as described below.

In order to examine and better clarify the basic concept of these new mechanisms, which appreciably change the energy efficiency in the mechanical transformation of these known machines, there shall be briefly explained the negative effect of these two residual chambers.

First of all there will be explained, for the sake of a comparative example, what takes place in a pneumatic or external fluid pressure engine which possesses these residual chambers. There is indicated, as one of the representative engines of that type, the one described in Spanish Pat. No. 432,982.

In such engines, when a decreasing chamber completes its discharge phase and the intake port or valve opens, at this time the chamber presents its minimum volume, but there nevertheless necessarily remains the volume of the two above-described residual chambers. If at this time a small volume of gas under a given pressure enters the chamber, the gas will expand into the volume which exists in these residual chambers, and therefore the gas pressure will decrease in the same proportion. If the volume of gas entering the chamber is the same as the volume already existing in the residual chambers, the effective pressure of the gas on the rotor system, which is what produces the motor couple or torque, will decrease by about one half, and that decrease takes place in a proportional manner during the entire intake phase, which phase is when the motoring or driving occurs.

On the other hand, if we compare the above behavior with that of an engine which does not have residual chambers, or wherein the residual chamber volume is close to zero, then when the same small volume of gas enters the chamber under the same given pressure, the initial pressure will not significantly decrease so that this pressure will be effective on the walls of the piston and vanes, whereupon the motor couple or torque is appreciably increased and the consumption of fluid is decreased, thus representing an important energy saving.

In a similar manner there will be compared a compressor of the type in which residual chambers do exist, and there is indicated, as representative of compressors of this type, the one of Spanish Pat. No. 432,981.

In such compressors, when there is effected in the chamber the compression and expulsion of the gas, the chamber is at its minimum volume, but the aforementioned residual chambers still exist, and as a result, the gas found in them will be compressed under practically the same pressure as that of the service to which the compressor is connected. The quantity of gas existing in the residual chambers will be that of their real volume multiplied by the pressure, without taking into account the expansion produced by the heat of compression. This residual gas was compressed during the compression phase, producing heat and consuming energy needlessly because this residual gas can not be expulsed due to the service pressure equilibrium. When the intake phase begins, those two residual chambers increase in volume, becoming a single common chamber, and the compressed gas which exists in them will expand, decreasing its pressure until the pressure becomes somewhat lower than that of the suction intake, at which time the compressor begins to suck in gas. For this reason, a part of the intake run is unprofitable, and this lowers the volumetric efficiency.

If these residual chambers could be eliminated upon reaching the end of the compression and expulsion run, which is an important object of the present invention, then substantially all of the gas which has been sucked in will be expulsed. Hence, when the intake run begins and the volume of said chamber increases, there will immediately occur a strong vacuum and the gases will enter from the beginning of the suction run, thus improving the volumetric and energetic efficiency.

Thus, an important object of the present invention is to provide a machine wherein, during each 90° rotation of the drum and vanes, each one of the three variable chambers will have both a maximum volume and a minimum volume which approaches zero. That is, during each complete rotation of the drum with its vanes, there is formed twelve times a maximum chamber and twelve times a minimum chamber, the volume of which will be approximately zero. The positions of these zero-volume chambers with respect to the stator are angularly spaced apart by 90° and always occur at the same location.

In order to obtain such a result, the axis of rotation of the drum must describe a hypocycloid in the form of a four-point star, as represented by 46 in FIG. 18, and the mechanism to obtain it is explained below.

In the above-given description of the known type of machine, it has been indicated that the drum has one or more coaxial hubs with a coaxial pinion which meshingly engages the inside of a ring gear. The pinion, in order for it to engage in a continuous manner with the inside of the ring gear in a rotating ratio of 3 to 1, a ratio which is necessary in order for the machine to execute the desired cycles, must have a diameter equal to six times the radius of the eccentricity, and the ring gear must have a diameter equal to eight times the radius of the same eccentricity. From the above it results that the ratio between the diameters of the ring and pinion is 4 to 3.

One variation of that type of engagement with the same 3 to 1 ratio is the one which exists in the internal combustion engine found in U.S. Pat. No. 4,314,533. In this latter engine, the center of rotation of the drum describes an orbit which is a perfect ellipse, but the diameter of the pinion which is coaxial with the drum is six times the value of the first eccentricity, more or less the value of the second eccentricity, which is exactly six times the value of the radius of the first eccentricity. The inner toothed ring of that engine, however, can not be circular since the geometric center of the drum describes an ellipse, and in order to the coaxial pinion to engage in a noninterrupted manner with the inside of the ring, the latter must copy the orbit of the former and it therefore has an elliptical profile but, in order to obtain the desired ratio of 3 to 1, the perimeter of the ring must be equal to 4 to 3 the perimeter of the pinion, which is a constant in all of the described machines. The engaging of a circular pinion with a ring which is elliptical in shape is feasible because the curve of the concavity of the ring is more open than the cylindrical curve of the pinion and envelops the latter with excess, something which permits the engaging. Nevertheless, in this system of elliptical engaging, there can be obtained only two positions in which, when each one of the three chambers passes by, the chambers have a volume approaching zero. Those positions are diametrically opposite by 180° so that, at the most, only six complete identical cycles are possible during each rotation of the drum.

In order for a machine of the stated class to execute 12 cycles per drum rotation with a zero chamber, the geometric axis of the drum must of necessity describe a hypocycloid orbit in the form of a four-point star. This trajectory is necessary in order to obtain four positions in which, when each chamber passes one of these positions, each one of the three chambers will have a volume which is practically null. The ring gear necessary in order to obtain this trajectory would also have to possess a hypocycloid profile in the form of a star with four points, and would have to maintain with the coaxial pinion of the drum the essential 3 to 1 ratio. If the ring gear possesses the shape of a four-point hypocycloid, then when the pinion which engages the inside of the ring gear within any of its quadrants comes to a position near one of the ring points, the teeth of the pinion also meet the teeth of the adjacent quadrant of the ring gear and thus it is impossible for them to properly engage. In addition, when those teeth of the pinion meet in the adjacent quadrant of the ring gear, the relative engaging between them is the reverse, that is to say in the opposite direction, and therefore making it impossible for the system to operate.

If the above-described engaging of the pinion and ring gear could be achieved without teeth, in a manner which would be a perfect threadlike engagement without slipping, the fluctuation in the rotation of the drum with its consequent accelerations and decelerations would render its proper functioning practically impossible. All of this assumes that such a type of threadlike engagement would be possible to construct.

Up to this point, there has been set forth a schematic description of the existing machines of this general type, and there have been cited those patents which are considered as most representative, in order to better explain and situate the innovations and mechanisms which are the objects of the present invention, and which will be described below.

In order to achieve the rotation of the drum so as to follow an orbit in the form of a four-point star, the conventional pinion and ring gear as mentioned above have been replaced by driving forks and a driven triangle, which constitute one of the preferred mechanisms of the present invention, in order to obtain, in this type of machine, the mentioned chambers with an approximately null volume.

The aforementioned mechanism basically comprises an equilateral triangle in the vertices of which there are located three parallel knobs or pins which are directed in the same direction so as to be parallel to the axis of rotation. The triangle is mounted on and against the drum in a manner very similar to, and substitutes for, the coaxial pinion which exists in the above-described known machines. The rotation of the triangle is controlled by driving forks which cause it to rotate with the same 3 to 1 ratio necessary for the production of the twelve work cycles in an engine with three vanes, and which are capable of additionally controlling the drum by accelerating or decelerating it at those times when accelerations and decelerations are needed to provide good operation and efficiency. The driving forks can also impart to the drum a completely uniform velocity, it being understood that the output shaft of the machine also rotates at uniform speed.

Another object of the present invention is that of obtaining a machine wherein the center of rotation of the drum describes a hypocycloid in the form of a four-point star so that, when the three chambers pass through each of the four quadrants, each chamber will have an approximately nonappreciable volume, the advantages of which in volumetric as well as energetic efficiency have already been presented in the aforementioned comparative descriptions.

Another facet of the invention is that it makes it possible to balance the drum together with its complements, by means of a mechanism which obtains the transformation of the four-point hypocycloid, permanently adjusted by its center of masses or of gravity in a circle, thus cancelling the components which might result from its accelerations and decelerations and balancing that resultant in a conventional manner by means of counterweights of circular rotation.

In order to clarify the most important concepts which characterize this invention and substantially modify the known types of machines, there are attached to the present description illustrative drawings, given only as an example, in which there are indicated the most essential particularities of the invention.

DETAILED DESCRIPTION

Figures 1, 2, 3, 4, 5, 6:
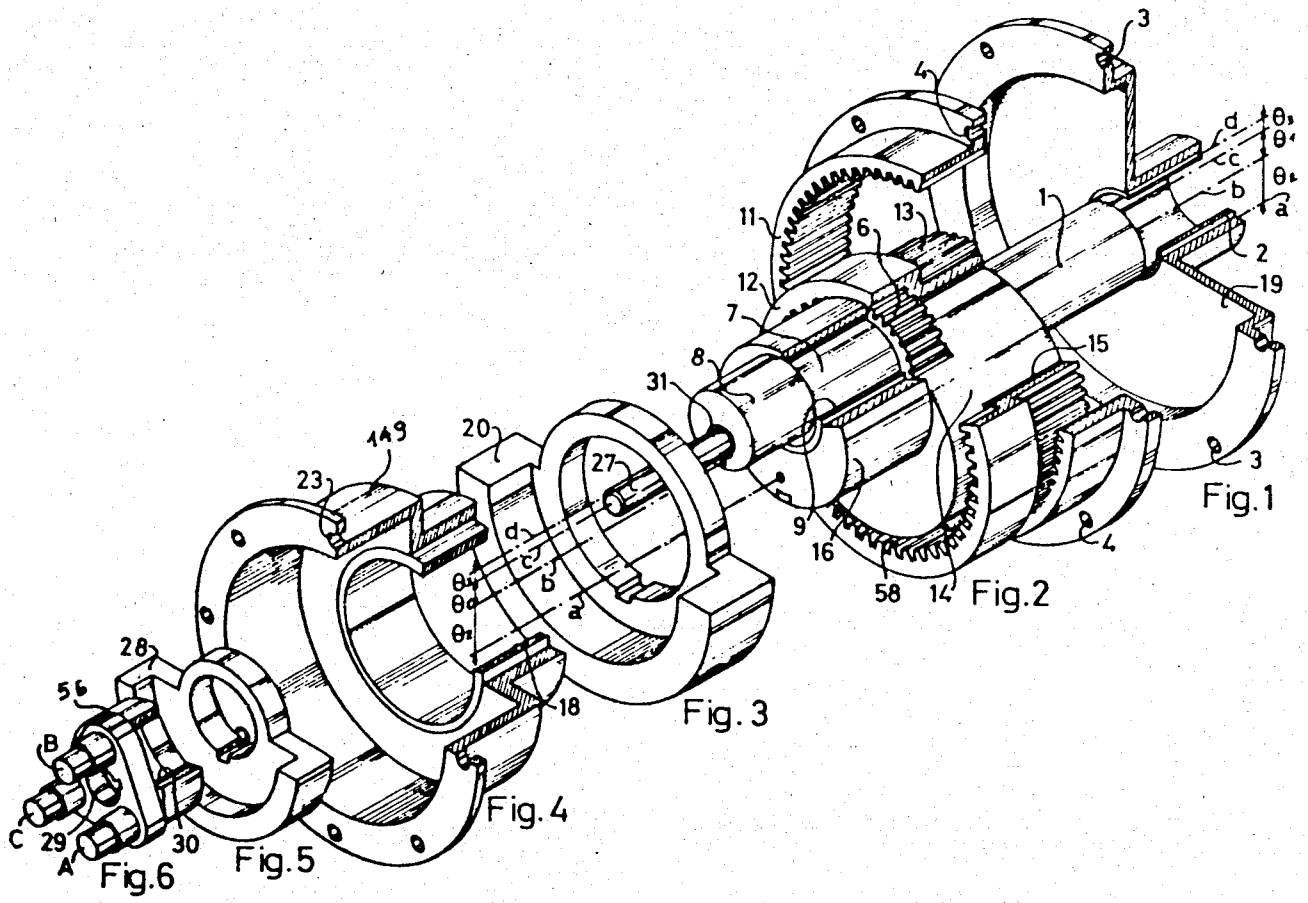
FIGS. 1 to 17 represent, in schematic perspective, the parts of a motor driven by external fluid pressure, which motor illustrates the innovations on machines such as compressors, pumps and vacuum machines, and in which it is possible for each rotation of the rotor to result in twelve cycles with a practically nonexistent volume in each chamber whenever a new expansion phase begins.

FIG. 1 represents a cover or end wall 19 for the housing, which cover mounts centrally thereof a bearing 2 for the output shaft 1. The cover flange has openings 3 which align with openings 4 (FIG. 2) and with threaded openings 5 (FIG. 9) for receiving screws (not shown) which hold the cover assembled with the flange 10 (FIG. 9) of housing 65.

FIG. 2 illustrates the mechanism which causes drum 21 (FIG. 13) to describe a hypocycloid orbit in the form of a four-point star. There can be seen in FIG. 2 a static internally toothed circular ring 11 which is concentric with shaft 1 and fixed relative to housing 65. Ring 11 engages the external teeth 13 of orbital ring 12, which ring 12 is rotatably supported by bearing 15 around an eccentric shaft part or crank 14. The eccentric 14, which is fixed to shaft 1, has its geometric center or axis "a" parallel to but radially spaced from the rotational axis "b" of output shaft 1, this radial spacing or eccentricity being designated $\theta_2$. The output shaft (or crankshaft) 1 has a further shaft part 16 fixed thereto, the geometric axis of part 16 also being the axis "b". This shaft end 16 is rotatably supported by bearing 18 (FIG. 4) within a bearing holder 149 which is fixed to housing 65. The shaft 1 also has a shaft part 27 fixed to and extending axially from the shaft part 16. This shaft part 27 has its geometric center on the axis "c" as defined below.

FIG. 2 illustrates the train of a second eccentric or crankshaft which includes an externally toothed pinion 6 which is fixed to and concentric with a shaft 7. This shaft 7 is rotatably supported within a bearing 9 which is positioned within an opening which extends axially of shaft part 16. This opening is radially (that is, eccentrically) positioned relative to axis "b" so that the geometric and hence rotational axis "c" for shaft 7 and pinion 6 has an eccentricity $\theta$ relative to axis "b". The shaft 7 has an eccentric or crank 8 fixed thereto, the geometric axis "d" of which is parallel to but radially spaced from axis "c" by the eccentricity $\theta_3$. The shaft part 27 projects axially through the eccentric 8 in radially offset relation from the axis "d", and is rotatable relative thereto due to a bearing 31 interposed therebetween.

The teeth on pinion 6 engage the internal teeth 58 on the orbital ring 12, whereby the eccentricity $\theta_1$ of the pinion 6 is complemented by eccentricity $\theta_2$ of ring 12 so that, by means of the engagement of teeth 13 with teeth 11, the eccentric 8 performs three absolute rotations, and in the opposite direction, for each rotation of the output shaft 1, or four rotations relative among themselves. The teeth 13 and 58 are generated on the same diameter.

The shaft 8, 7, 6 rotates around the axis "c" and, because of its location, this shaft 6-7-8 also functions as an arm of the first crankshaft 1 in that it moves in a circular orbit around the axis "b" of shaft 1 with a radius of rotation which is the value of the eccentricity $\theta_1$.

Figures 11, 12, 13, 14, 15, 17:
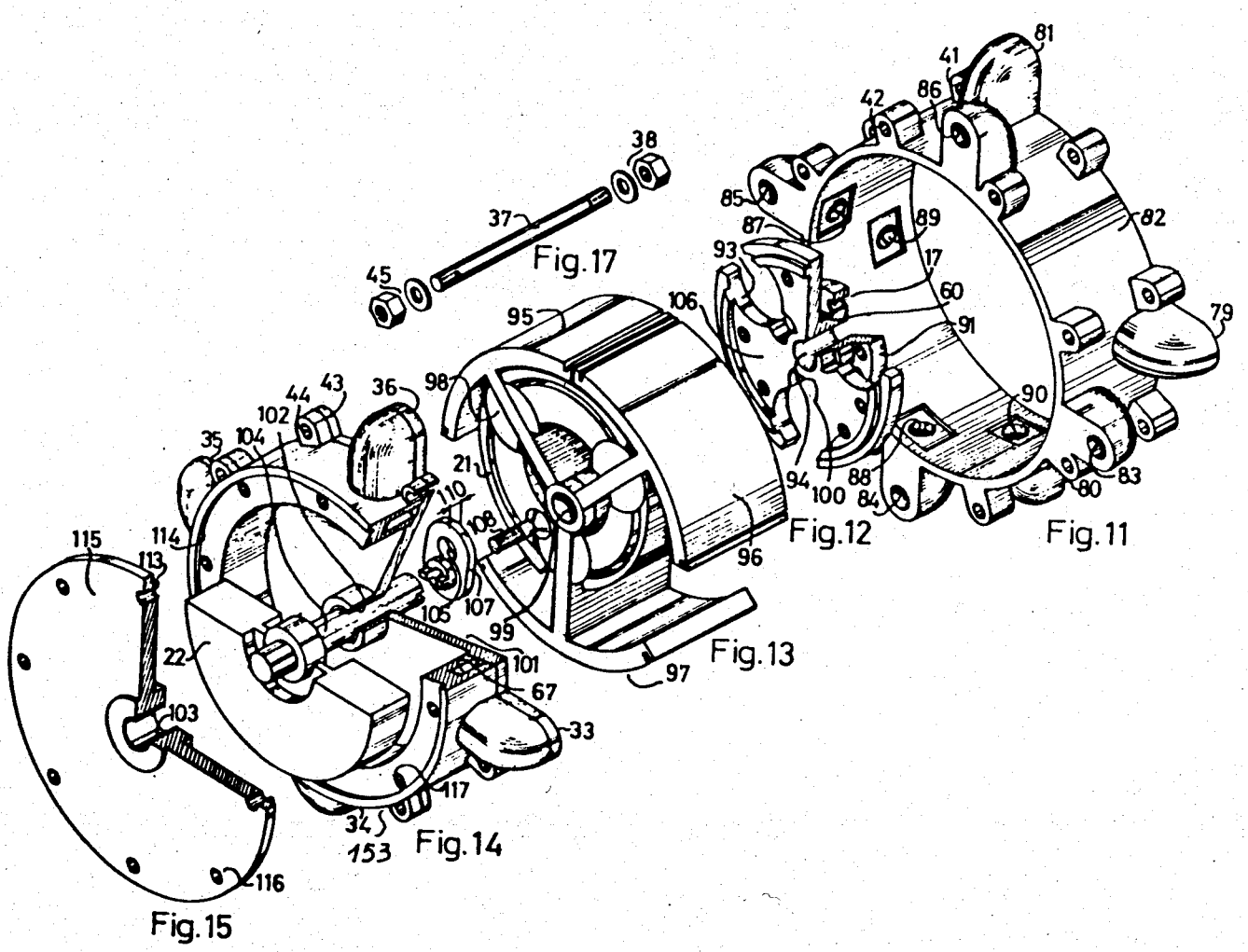

FIG. 3 illustrates one of the rotatable counterweights 20 which, together with counterweight 22 in FIG. 14, dynamically balance the rotor system. The counterweight 20 is rigidly assembled on shaft 16 as seen in FIG. 2, adjacent to the pinion 6.

FIG. 4 illustrates the bearing holder 149 provided with a flange having therein openings 23 which align with openings 24 (FIG. 7) in member 150, and with threaded openings 25 (FIG. 9) in housing 65. By means of screws (not shown) all of these members are fixedly assembled against the shoulder 26 (FIG. 9) at the inner end of housing 65.

FIG. 5 illustrates the compensating counterweight 28, the rotation of which is not circular and the mass center of which is always in a counterposition relative to the mass of drum 21 (FIG. 13) such that the result of multiplying the mass center of the drum 21 running about axis "d" as its center of rotation, by the eccentricity $\theta_3$, has the same value as the result of multiplying the mass center of the counterweight 28 by the radial distance between the same mass center and the rotational axis "c". This counterweight 28 is rigidly mounted on the eccentric 8.

Figures 7, 8, 9, 10, 16:
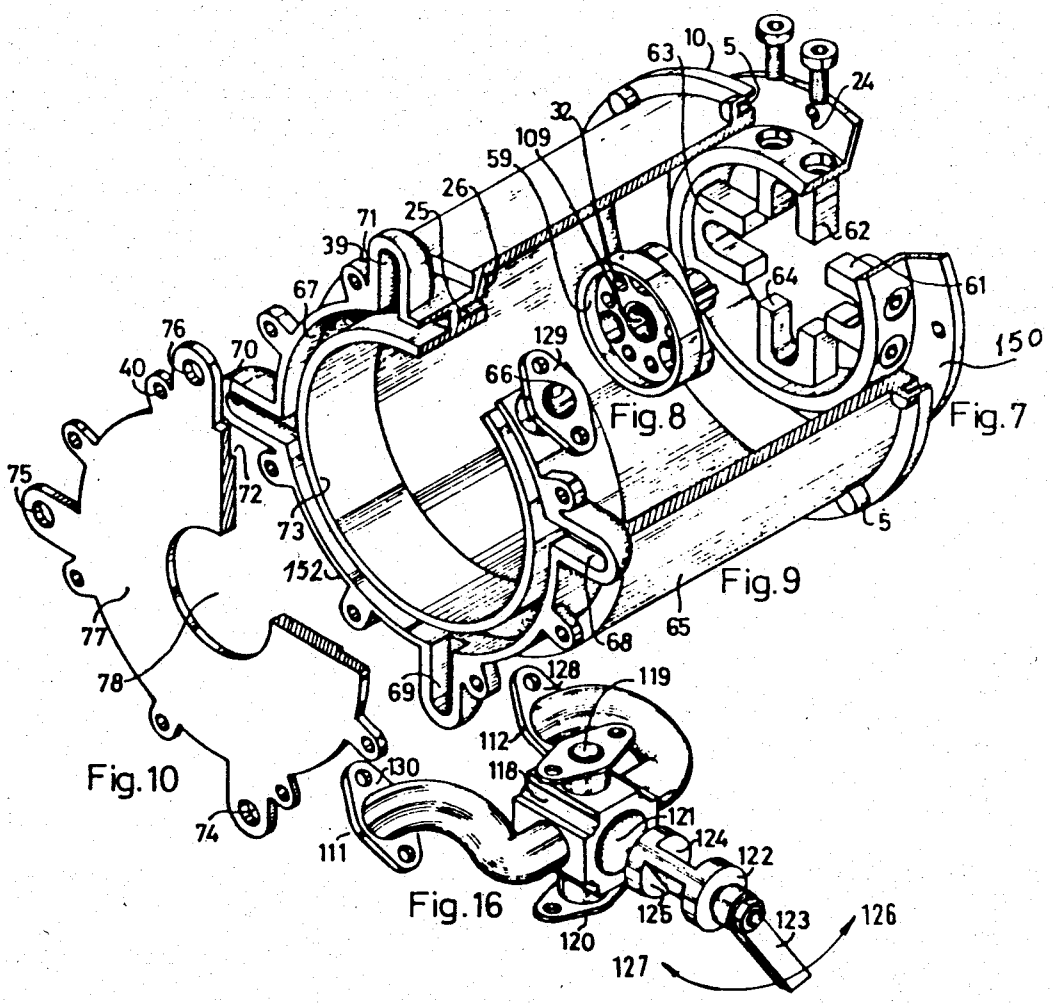

FIGS. 6 and 8 illustrate a driven triangle 56 used for drivingly connecting the drum 21 to the eccentric 8, which triangle is shown in two parts for clarity of illustration. The triangle 56 has a central opening 29 through which passes the shaft 27. The minimum radius of opening 29 is equal to the radius of shaft 27 plus the value of eccentricity $\theta_3$ so that the triangle can orbit in a circular manner around the shaft 27. A bearing 30 rotatably supports the triangle 56 on eccentric 8. The driven triangle has an axially projecting annular hub 59 which is surroundingly seated on a circular plate 91 (FIG. 12), which plate is rigidly and coaxially joined to drum 21 by means of annular hub or neck 60. Screws (not shown) extend through openings 32 and are threaded in openings 17 so that the triangle 56 and drum 21 form a rigid entity. The triangle 56 has three protrusions or pins A, B and C projecting axially thereof toward the drum 21, which pins define the corners of an equilateral triangle.

FIG. 7 discloses a ring member 150 which is coaxially fixed to the housing 65. This ring member mounts thereon four driving forks 61, 62, 63 and 64 which are described hereinafter.

In FIG. 9 there is illustrated the central sleevelike cylindrical housing 65 which encloses the main part of the mechanisms shown in FIGS. 2–8. Housing 65 has a collector ring 152 at one end which defines an annular distributing duct 67. A nozzle 66 permits fluid to either enter into or exit from the duct 67, depending on the direction of rotation of the rotor. Four elbows 68, 69, 70 and 71 communicate with duct 67.

FIG. 10 shows a lateral cover or plate 77 which is fixedly positioned between the adjacent ends of the housing 65 and the cylinder 82 (FIG. 11). The plate 72 has, on its posterior face, a raised center hub part 72 which fits into the opening 73 to center the plate and seal the collector 152. This plate 77 also has four holes such as 74, 75 and 76 therethrough which communicate with elbows 68–71 and cause these elbows of collector 152 to communicate with the four respective elbows such as 79, 80 and 81 (FIG. 11) of one side of the cylinder 82. The end faces of the drum and vanes also slidably engage the axial end face of plate 77. Plate 77 has a central opening 78 through which projects the hub or neck 60 of drum 21, said opening 78 having a greater diameter than neck 60 so that the latter can orbit inside the former.

FIG. 11 illustrates the cylinder 82 which is fitted with sets of four elbows adjacent the opposite axial ends thereof (only three elbows of one set being visible in the figure). The elbows 79, 80 and 81 of one set communicate with collector 152, and the elbows 83, 84, 85 and 86 of the other set communicate with the duct 167 of collector 153 (FIG. 14). The cylinder 82 has a set of four intake ports and a set of four exhaust ports through which the elbows communicate with the interior of the cylinder 82, the individual intake ports as well as the exhaust ports being angularly spaced apart by 90°. In the drawing there can be seen only two ports 87 and 88 of one set, and two ports 89 and 90 of the other set, the two sets being located in radial planes adjacent the opposite axial ends of the cylinder. The intake ports, relative to the exhaust ports, are angularly offset.

FIG. 12 illustrates the end plate 106 for the drum 21 (FIG. 13), which plate 106 has the output hub or neck 60 projecting coaxially thereof through the central opening 78 of the plate 77. There is also shown the plate 91 with its threaded openings 17 for assembling with the driven triangle 56, 59. The drum 21 has slotlike openings or lodgings 93 for rotatably accommodating the swivels 98, and also has a central opening 94 for the passage therethrough of shaft 27 in FIG. 2, which drum 21 with its plate 106 orbits around shaft 27 with an orbit determined by the value of the second eccentricity $\theta_3$. The holes 100 accommodate screws for fixing the plate 106 to the drum 21.

In FIG. 13 there is represented in a schematic manner the rotor system which includes the three blades or vanes 95, 96 and 97, the swivels 98 which mount the vanes on the drum 21, and the rings 99 on the inner ends of the vanes, which rings 99 are rotatably supported on shaft 104 (FIG. 14).

FIG. 14 illustrates the other collector 153 which is basically equal to the collector 152 described in FIG. 9, the cylinder 82 being fixed axially between both of them. This collector 153 has an end plate 101 which closes off the adjacent end of cylinder 82 and, when assembled with the collector 153, closes off the distribution channels 67. Collector 153 has thereon a set of four elbows 33, 34, 35 and 36 which respectively align and communicate with the elbows 83, 84, 85 and 86. The plate 101 is fitted with a central bearing 102 which, together with bearing 103 on the end cover 115 (FIG. 15), support the shaft 104 for rotation on the geometric center or axis "b" of the cylinder 82, and therefore the vanes 95, 96 and 97 can freely rotate around said shaft 104 by means of rings 99 with which each vane is fitted.

The shaft 104 is rigidly united to the counterweight 22 which, together with counterweight 20 in FIG. 3, dynamically balances the entire system.

The rotation motion of the shaft 104 is produced in the following manner. In the first place, the shaft 104 runs through the rings 99 of the vanes. The end of shaft 104 has a radially projecting crank 107 fixedly fastened thereto, as by a screw 108. Thereafter, it is possible to assemble the end plate 106 to the drum, as by means of screws. The crank 107 is thus positioned directly adjacent the internal wall of plate 106. The crank 107 has a hole 105 therethrough, and the radial distance between the axis of shaft 104 and the geometric center of hole 105 is the value of the first eccentricity $\theta_1$.

As already described, shaft 27 is a rigid and nonrotating arm of the first crankshaft so that the axis "c" of shaft 27 describes a circular orbit around axis "b" every time the crankshaft 1-14-16-27 rotates, which orbit has a radius equal to the first eccentricity $\theta_1$. If we consider the engine as assembled, we will see that the shaft 27 runs through various members with central openings such as 29 in FIG. 6, 109 in FIG. 8 and 94 in FIG. 12. As stated above, all of those holes have a radius greater than that of shaft 27 since said members in FIGS. 6, 8 and 12 are imparted with a hypocycloid orbit (and not a circular one as the shaft) with a value equal to the second eccentricity $\theta_3$. The shaft 27, once the engine has been assembled, projects from hole 94 into hole 105 for fixedly fastening the shaft 27 to the crank 107.

Since shaft 27 describes a circular trajectory, the radius of which has the value $\theta_1$, and since the distance between the axes of shaft 104 and hole 105 has the value $\theta_1$ of the first eccentricity, it will result that for each rotation the motor shaft 1 performs, the shaft 104 with its counterweight 22 also performs a rotation in the same direction.

In FIG. 14, there has not been illustrated the inlet or output nozzle which communicates with the distribution channel 67 because such nozzle is located on the not-illustrated section. This nozzle is practically identical to, and located in the same relative location, as nozzle 66 in FIG. 9.

The frontal end plate 115, as shown in FIG. 15, has an annular embossment or projection 113 which seats within the end bore 114 of collector 153 to center the plate. Openings 116 are provided for screws which are threaded into holes 117.

FIG. 16 represents in a schematic manner the fluid flow-reversing control mechanism which basically comprises a distribution box 118 with a cylindrical passage 121 and which, in practice, can be slightly cone-shaped in order to ensure a better seal. Axially arranged inside said passage 121 is a rotatable valve spool 122 operated by crank or handle 123. The spool 122 has two grooves 124 and 125 which serve to change the direction of the fluid. The distribution box 118 is perpendicularly crossed by two ducts 111-112 and 119-120 which intersect the passage 121.

Plate 128 on one conduit 111 of the reversing mechanism is assembled with plate 129 of nozzle 66 in FIG. 9, and plate 130 on the other conduit 112 of the mechanism is assembled in the same manner on the other nozzle (not shown) associated with distributor 153. Fluid always enters the reversing unit through duct 119 and, if spool 122 is in position 126, the fluid from duct 119 is deflected by groove 124 so that it enters through duct 112 and nozzle 66 (FIG. 9) into distribution channel 67, then through elbows 68–71 and openings 74–76, and then through elbows 79–81 for discharge through intake ports 89 and 90 and the remaining intake ports which are not visible. The fluid entering the cylinder 82 causes the rotor (FIG. 13) to rotate in a counterclockwise direction. The fluid is then expelled through discharge ports 87, 88 to the elbows 83–86 and then to the elbows 33–36, and then through distribution channel 67 from which the fluid exits through the not-shown nozzle which joins with plate 130, said fluid passing through duct 111 and being deflected by groove 125 and finally exiting through duct 120.

When handle 123 is in position 127 (FIG. 16), all of the fluid which enters through duct 119 will be deflected by groove 125 through duct 111 into duct 167 of collector 153. The fluid will thus enter cylinder 82 through the intake ports, in this case the ports 87 and 88. After that fluid has imparted to the rotor system of FIG. 13 a rotation motion in a clockwise direction, it will be discharged through ports 89, 90, said fluid flowing along a path which is the reverse of the preceding one described above. With this reversing system, it can be seen that whatever may be the rotational direction of the rotor, the fluid always enters through duct 119 and always exits through duct 120. Only the position of handle 123 channels the fluid in one direction or the other, causing the system to change the direction of rotation.

In FIG. 17 there is represented a single pin 37 with its corresponding screw nuts 38 and 45, eight such pins being used. Those pins act as bolts for securing the flanges axially of the housing. Collector 152 has flanges 39, plate 77 in FIG. 10 has flanges 40, the cylinder 82 has aligned flanges 41 and 42, the plate 101 in FIG. 14 has flanges 43, and collector 153 in FIG. 14 has flanges 44. These pins 37 are screwed, by means of nuts 38 and 45, against the flanges 39 and 44 to fixedly assemble this housing complex.

Figure 18:
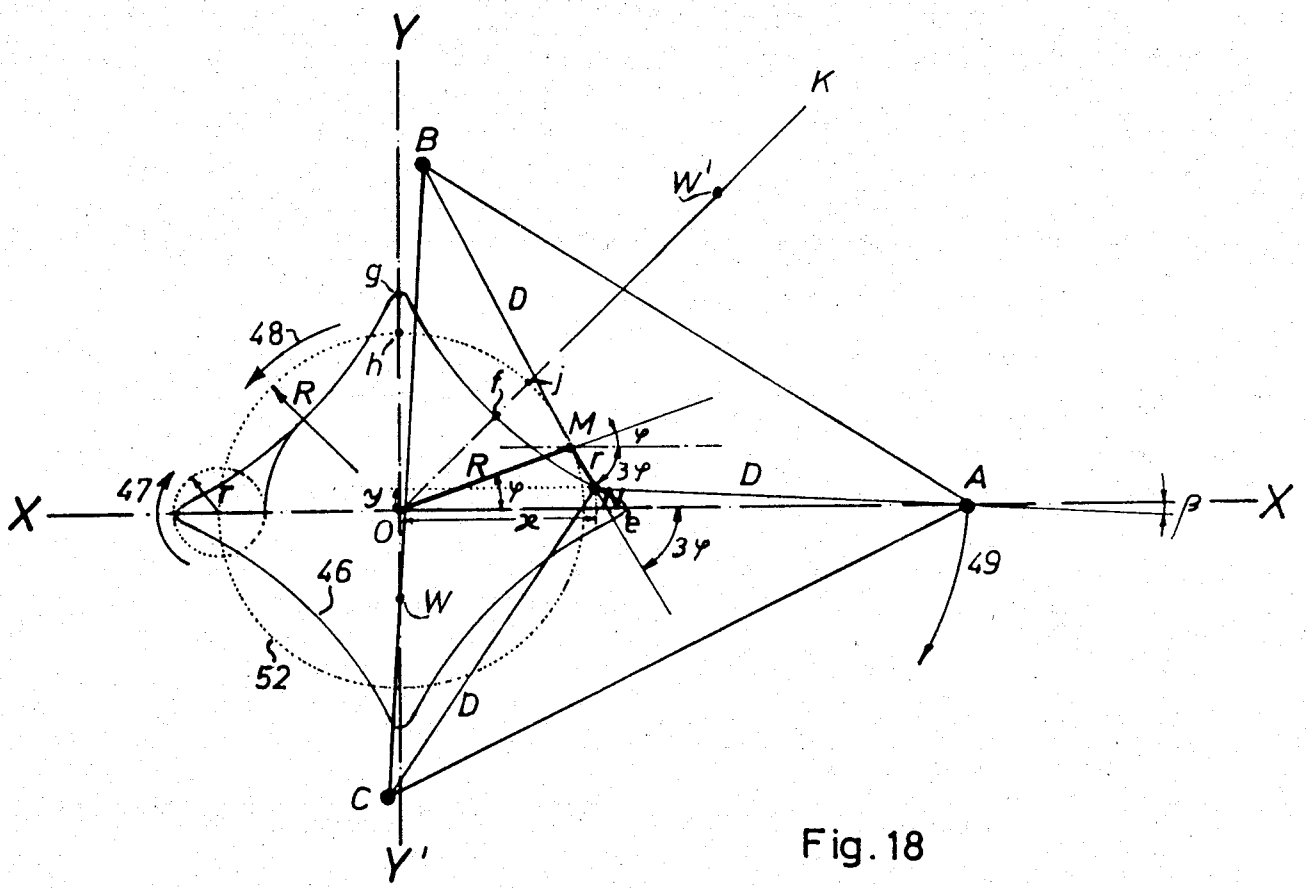
FIG. 18 is a diagrammatic illustration for explaining the velocity of the driven triangle.

Referring now to FIG. 18, it graphically represents the displacement of the eccentricities and the equation for which the geometric center of the drum as it describes a four-point hypocycloid. It also represents the controlled rotation of the drum when its center passes over the hypocycloid. The mechanisms to obtain such an effect will be described below.

In FIG. 18, R is the radius of the first eccentricity which is equal to $\theta_1$, and r is the radius of the second eccentricity which is equal to $\theta_3$. The chosen relationship between these two radii to determine the hypocycloid represented in FIG. 18 is $R = 4r$. This relationship has been chosen as being one of the most logical ones.

In order to obtain a decreasing chamber volume which at the end of its run has a volume of approximately zero, one of the indispensible conditions is for the geometric center of the drum to move over a path defining a four-point hypocycloid. But, in order for that to happen, it is necessary that when the arm OM (that is, the radius R which rotates about center 0) has rotated in a given direction through an angle $\psi$, the arm MN (that is, the radius r which rotates about center M) will have rotated through an angle of $3\psi$, in the opposite rotational direction. N is the geometric center of the drum 21.

If we cause the first eccentricity OM to rotate around center 0 of the X-Y coordinates, and if we cause the second eccentricity MN to rotate around point M, the equation of the points of that hypocycloid will be:

$$X = OM \cos \psi + MN \cos 3\psi.$$

$$Y=OM \sin \psi - MN \sin 3\psi.$$

or what is equal to:

$$X=\theta_1 \cos \psi + \theta_3 \cos 3\psi.$$

$$Y=\theta_1 \sin \psi - \theta_3 \sin 3\psi.$$

With these equations, if we assign values to $\psi$ which correspond to the angle of rotation of the output shaft of the machine, we obtain the curve 46 for the hypocycloid represented in FIG. 18.

In said FIG. 18, if we assume that R rotates in the direction of arrow 48, then r rotates in the opposite direction as shown by arrow 47, and $\beta$ is the angle of rotation of triangle ABC which rotates about a center N with a ratio of 1 to 3 with respect to the output shaft, or that is, $\psi=3\beta$, and in the reverse direction. Partial accelerations are ignored.

When that equation is applied, it follows that the geometric center of the drum which is at N in FIG. 18 runs over the hypocycloid path 46 but, in order that the cycles (that is, the twelve cycles per revolution) be exactly equal and always repeated at the same locations, it is necessary for the drum to rotate with a 1 to 3 ratio with respect to the output shaft, that is, three times less and in the reverse direction. But, as we have seen before that, in the case when the center of the drum describes a hypocycloid with four points, it is not possible for a pinion coaxial with the drum to engage an internally toothed ring gear for the reasons already explained. That is why, in order for the ratio of 1 to 3 to be obtained, there is provided a mechanism comprising forks 61–64 which coact with the triangle 56 coaxially affixed to the drum, to rotate with a ratio of 1 to 3 with respect to the driving shaft and in the reverse direction. It is further possible, with this mechanism, to control the partial accelerations at those times which prove beneficial for good operation, said mechanism being one of the preferred objects of the present invention.

This mechanism and system will be explained in two schematically represented forms of execution, one which causes the driven triangle to rotate with a uniform displacement or motion, and the other of which causes that triangle to undergo a few accelerations, assuming in both cases a uniform velocity of the output shaft.

In FIG. 18, there is explained the case in which the velocity of $\beta$ of the triangle is not uniform. In that figure, there is represented an equilateral triangle ABC with a center N, NA=NB=NC, and a distance or radius D, its value being:

$$D = \frac{(R - r) \sin 45}{\sin 15} = \frac{(\theta_1 - \theta_3) \sin 45}{\sin 15}$$

This driven equilateral triangle ABC is represented in FIG. 6 at 56 and the pins A, B, C thereon represent the points of the triangle ABC in FIG. 18.

If the arm of the motor shaft MN is made to rotate from 0° to 45°, the center N of triangle ABC (which is also the center of the drum 21) will run over hypocycloid 46 from "e" to "f", but if while that center travels from "e" to "f" point, A is made to move along the axis XX', we find that for any value of $\psi$ between 0° and 45° there will be formed a right-angled triangle the hypotenuse of which is known, that being NA.

NA being equal to D, therefore its value will be:

$$NA = D = \frac{(\theta_1 - \theta_3) \sin 45°}{\sin 15°}$$

We also know the "y" leg of the right-angled triangle which was found before to determine the curve of the hypocycloid and its value is:

$$Y=R \sin \psi - r \sin 3\psi.$$

This data is sufficient to find angle $\beta$ of rotation of the driven triangle and therefore of rotation of the drum. There will therefore result that:

$$\beta_{15°}^{0°} = \text{arc sin} \frac{R \sin \psi - r \sin 3\psi}{D}$$

After $\psi$ has rotated over exactly 45°, the point A will be on the axis XX' and point B will be on the axis YY', and in this position the value of $\beta$ is 15° which is the precise relationship of 1 to 3. As $\psi$ rotates from 45° to 90°, pin A will remain free and pin B will be forced to move along the ordinate axis YY' and the value of $\beta$ for any position of $\psi$ between 45° and 90° will be:

$$\beta_{30°}^{15°} = 30 - \text{arc sin} \frac{R \cos \psi - r \cos 3\psi}{D}$$

For $\psi$ of from 0° to 45°, the rotational velocity value of $\beta$ will have accelerated and, for $\psi$ from 45° to 90°, it will have decelerated in a symmetrically equal manner. The same pattern will take place in every quadrant. The value of these accelerations will be explained below.

Figure 19:
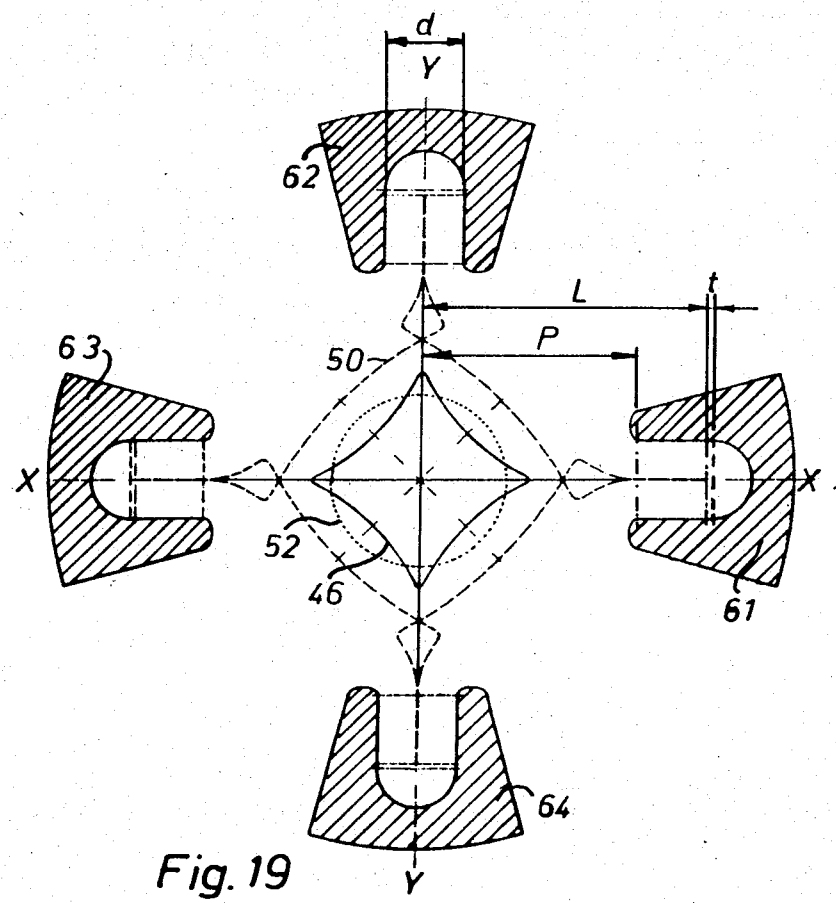
Figure 22:
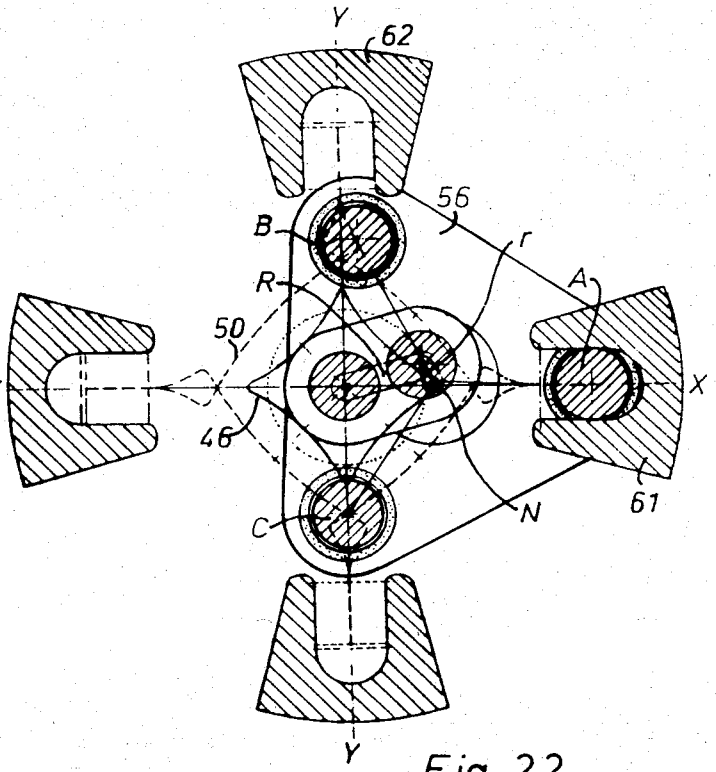

FIG. 19 represents the four forks 61–64 as provided with slots defined between opposed parallel faces. These forks force the driven triangle 56 to rotate on its own axis with a rotation $\beta$ which is continuous but not uniform. There is shown in FIG. 19 three curves. The first one is the hypocycloid 46, as represented in a solid line, which the geometric center of the driven triangle 56 and drum 21 generate in its orbit.

The second curve 52, as represented by a dotted line, is the circle described by the orbit of the first eccentricity or shaft 27.

The third curve 50, as represented by a broken line, is the path over which runs the geometric centers of pins A, B and C for each value of $\psi$ between 0° and 45°. Pin A will be located in Cartesian coordinates by values of X and Y according to the following equations:

$$X = R \cos \psi + r \cos 3\psi + D \cos \left( 360 - \text{arc sin} \frac{R \sin \psi - r \sin 3\psi}{D} \right)$$

$$Y = R \sin \psi - r \sin 3\psi + D \sin \left( 360 - \text{arc sin} \frac{R \sin \psi - r \sin 3\psi}{D} \right)$$

Pin B will be located by values of X and Y according to the following equations:

$$X = R \cos \psi + r \cos 3\psi +$$

-continued $$D\cos\left(120 - \arcsin\frac{R\sin\psi - r\sin 3\psi}{D}\right)$$

$$Y = R\sin\psi - r\sin 3\psi +$$

$$D\sin\left(120 - \arcsin\frac{R\sin\psi - r\sin 3\psi}{D}\right)$$

Pin C will be located by values of X and Y according to the following equations:

$$X = R\cos\psi + r\cos 3\psi +$$

$$D\cos\left(240 - \arcsin\frac{R\sin\psi - r\sin 3\psi}{D}\right)$$

$$Y = R\sin\psi - r\sin 3\psi +$$

$$D\sin\left(240 - \arcsin\frac{R\sin\psi - r\sin 3\psi}{D}\right)$$

With these equations which have been applied for each one of the three pins, each pin, for a rotation of $\psi$ from 0° to 45°, will have covered the path corresponding to it for an angle $\beta$ of 15° on curve 50, but each pin will have covered a distinct part of said curve 50. The continued sum of these three parts completes the part or section corresponding to 45° of $\beta$ which correspond to 135° of $\psi$, that is, they have completed the curve corresponding to a half-quadrant, but as that curve is completely symmetrical and cyclic for each half quadrant, when its origin is located on one of the coordinate's axes, it will be possible to complete and close the curve 50.

In FIG. 19 there is designated by "d" the diameter of the pins, which is also the separation distance between the parallel faces of the fork. The distance L is the value from one of the coordinate axes X or Y to the back of the parallel fork faces, and there is designated as "t" the accepted tolerance, so that L=R+r+D+t.

The distance P is the precise distance from a coordinate axis to the point at which the parallelism of the fork faces begins. For a pin to become free from a fork while the other pin remains in that same position controlled by the contiguous fork, and in order for that to take place at a precise time, the value of P must be:

$$P = (R - r)\left(1 + \frac{\sin 75°}{\sin 15°}\right)\cos 45°$$

Figure 20:
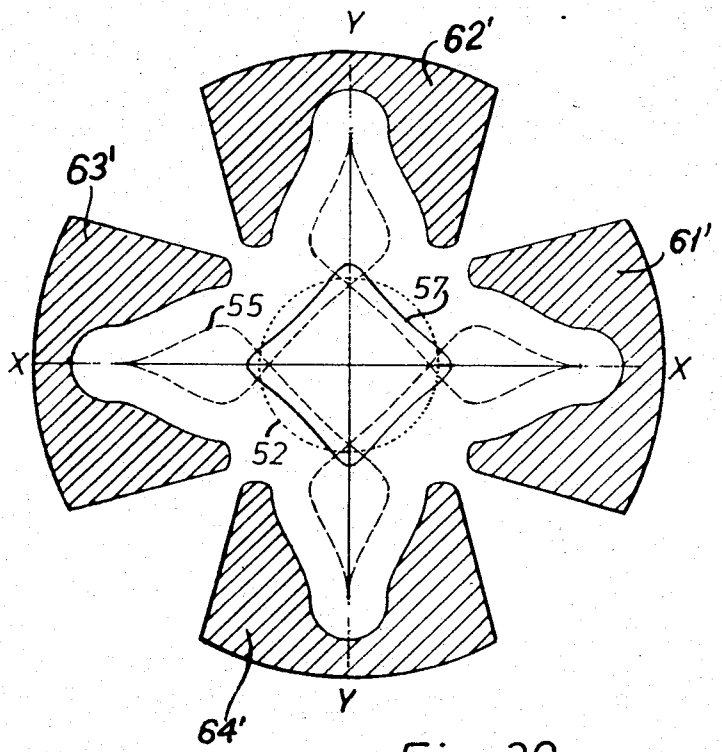
FIGS. 19 through 26 are radial sections which illustrate the relationships between the forks and the driven triangle.

In FIG. 20 there are represented modified forks designated 61'–64' which control the driven triangle 56 to impart to it a rotation $\beta$ which is uniform with respect to the uniform rotation $\psi$ and, as always, with a ratio of 1 to 3, so that the rotation of $\beta$ will always be $\psi/3$. The hypocycloid 57 is the path covered by the geometric center of the driven triangle 56 and drum 21 in its orbital displacement. The relationship between the radii R and r is now R=6r in order to give the shape 57. The condition of R=6r is not a necessary condition, but is a chosen condition for the desired function to be completed within logical limits. The circle 52 indicated by dots is the path covered by the arm of the first eccentricity or shaft 27, and curve 55 as indicated in broken lines is the movement path covered by the geometric center of each one of the three pins A, B, C. The equations which determine the path these pins follow is:

$$X = R\cos\psi + r\cos 3\psi + D'\cos(360 - \psi/3)$$

$$Y = R\sin\psi - r\sin 3\psi + D'\sin(360 - \psi/3),$$

the value of D' being, in this case solely, that of D'=1.5R. This latter value for D' is not a necessary condition, but it has been chosen because it fulfills the desired function.

In FIGS. 21, 22, 23 and 24 there are represented the same forks 61, 62, 63 and 64 and the same curves 46, 50 and 52 illustrated in FIG. 19. In addition, there are schematically represented the driven triangle 56, the crank arm 107, and the arms $R=\theta_1$ of the first eccentricity and $r=\theta_3$ of the second eccentricity. All are in distinct positions to illustrate their operation.

Figure 21:
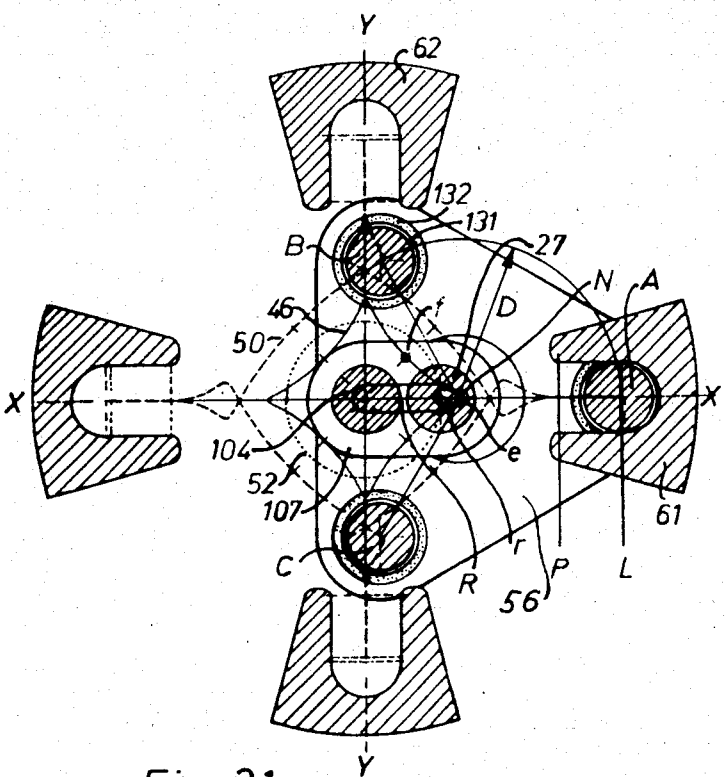

FIG. 21 shows the pin B mounted on a bearing 131 which in turn is mounted on a silent-block 132 which, even though it is not necessary, has been indicated in the figures so that there may be seen its assembling possibility. In FIG. 21 there is also seen the crank 107 with its shafts 104 and 27. The separation between the geometric centers or axes of these shafts 104 and 27 is the radius of the first eccentricity $R=\theta_1$.

There is also represented in a schematic manner, in these figures, the arm of the second eccentricity $r=\theta_3$. In these FIGS. 21 to 24, the elements have been designated with the same letters and numbers as those used in FIGS. 18 and 19, it thus being possible to interpolate the corresponding designs and equations between the different figures.

Figure 24:
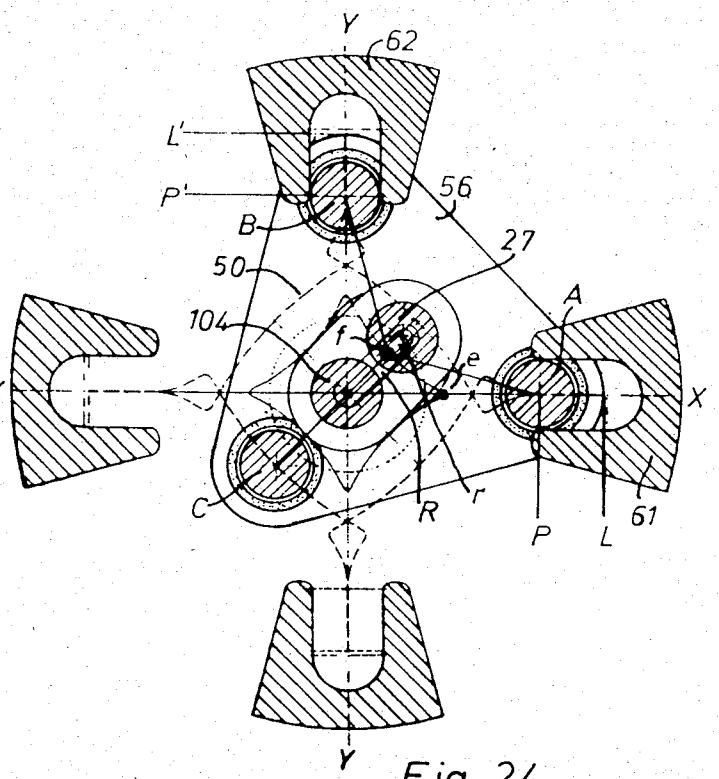
Figure 23:
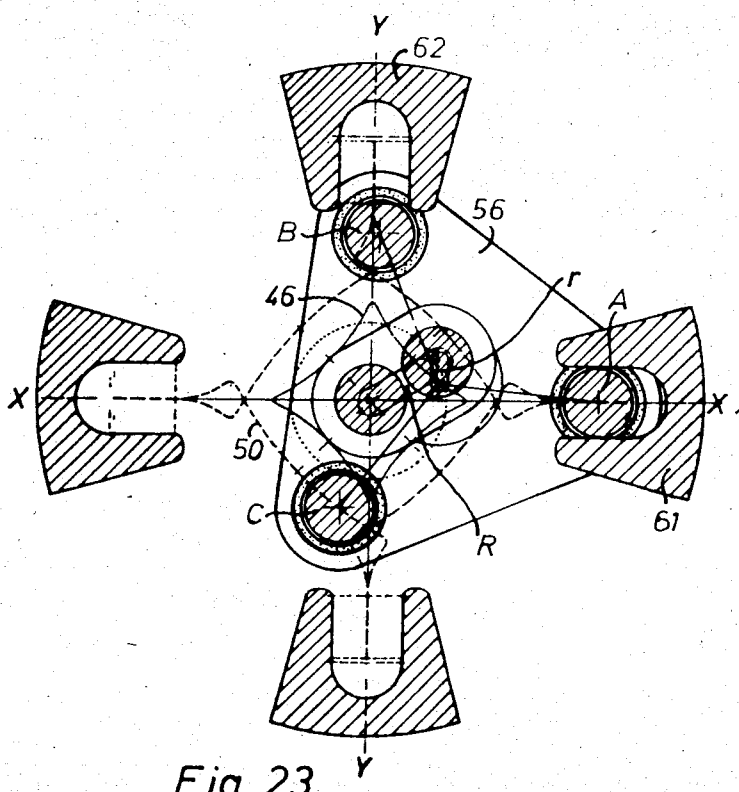

The positions in FIGS. 21 to 24 correspond to a rotation of $\psi$ from 0° to 45°, it being seen that the geometric center N of the driven triangle 56 moves along the hypocycloid path 46 from point "e" in FIG. 21 to point "f" in FIG. 24, and that pin A has been forced to slide inwardly between the parallel faces or arms of fork 61 from position L in FIG. 21 to position P in FIG. 24. This displacement of the triangle 56, forced through the center point N of the triangle and the center point of pin A, also forces the driven triangle to perform a rotation $\beta$ about its geometric axis N which is the reverse of rotation $\psi$ according to the equation:

$$\beta = \arcsin\frac{R\sin\psi - r\sin 3\psi}{D}$$

in which all of the data are known, that is to say, by giving $\psi$ values from 0° to 45°, we can determine the value of $\beta$ which is the rotation of the drum 21.

In the position represented in FIG. 24, the pin A has reached point P which is the final point of the parallelism in fork 61, so that pin A loses contact with said fork 61 so that fork 61 no longer has rotational control over the triangle. But, in that same position, pin B enters between the parallel arms of fork 62 at position P' and there will begin a displacement exactly equal to the above-described displacement, but in the opposite direction. That is, the value of the acceleration at a given point along the fork 61 will be inversely equal to the value at the same point of symmetry along the fork 62. When pin B has reached the end of its run at position L', the center N will then follow the hypocycloid 46 along the second quadrant, and the displacement of the triangle will be symmetrically equal.

When point N has completed an entire revolution on the hypocycloid 46, then upon reaching the initial position represented in FIG. 21, everything will be exactly the same except that pin B will now be engaged with fork 61, and pins A and C will be in the positions previously occupied by pins C and B, respectively. Thus, for a complete revolution of the triangle, that is a rotation of $\psi$ equal to 360°, pin A will have moved from its original position to the original position of pin C. Since the triangle is equilateral, the angular distance between these two positions is 120°, which signifies that for each 360° of $\psi$, we will have a rotation $\beta$ of 120°, which represents a relationship of 3 to 1.

In order to illustrate the accelerations and decelerations which the driven triangle undergoes, which in the final analysis are also those of the drum 21, we shall give $\psi$ values from 0° to 45° in 5° increments, and we shall apply them in the following previously defined equation $$\beta = \text{arc sin}\,\frac{R \sin \psi - r \sin 3\psi}{D}$$

and knowing the ratio R=4r, and also the value of $$D = \frac{(R - r) \sin 45°}{\sin 15°}$$

we shall have the values for the angles of $\beta$ and their accelerations.

Rotation of $\psi$ through 5°, rotation of $\beta$ through 0° 37′ 41″

Rotation of $\psi$ through 10°, rotation of $\beta$ through 1° 21′ 40″

Rotation of $\psi$ through 15°, rotation of $\beta$ through 2° 17′ 42″

Rotation of $\psi$ through 20°, rotation of $\beta$ through 3° 30′ 43″

Rotation of $\psi$ through 25°, rotation of $\beta$ through 5° 04′ 19″

Rotation of $\psi$ through 30°, rotation of $\beta$ through 7° 00′ 29″

Rotation of $\psi$ through 35°, rotation of $\beta$ through 9° 19′ 41″

Rotation of $\psi$ through 40°, rotation of $\beta$ through 12° 00′ 29″

Rotation of $\psi$ through 45°, rotation of $\beta$ through 15° 00′ 00″

For $\psi$ from 45° to 90°, the angle $\beta$ will increase by the same values as from 0° to 45°, but in the opposite direction (that is, the valves of $\beta$ are symmetrical about $\psi$ of 45°) until $\psi$ reaches 90°, at which time $\beta$ will be equal to 30°. The same thing will occur in each quadrant.

With the above data we can see the acceleration of $\beta$ for each 5° increment of $\psi$ will be the following:

From 0° to 5° of $\psi$, the acceleration of $\beta$ is 0° 37′ 41″; from 5° to 10° for $\psi$, the acceleration of $\beta$ is 0° 43′ 59″; from 10° to 15° for $\psi$, the acceleration of $\beta$ is 0° 56′ 02″; from 15° to 20° for $\psi$, the acceleration for $\beta$ is 1° 13′ 01″; from 20° to 25° for $\psi$, the acceleration of $\beta$ is 1° 36′ 36″; from 25° to 30° for $\psi$, the acceleration of $\beta$ is 1° 56′ 10″; from 30° to 35° for $\psi$, the acceleration of $\beta$ is 2° 19′ 12″; from 35° to 40° for $\psi$, the acceleration of $\beta$ is 2° 40′ 48″; and from 40° to 45° for $\psi$, the acceleration of $\beta$ is 2° 59′ 32″.

From 45° to 90°, the drum 21 is subjected to a deceleration which is equal to the above acceleration, and this will take place in each quadrant.

Some of the equations which have been presented could have been simplified, or they could have been presented differently, but they have been developed in the above manner in order to better clarify their function.

Figure 26:
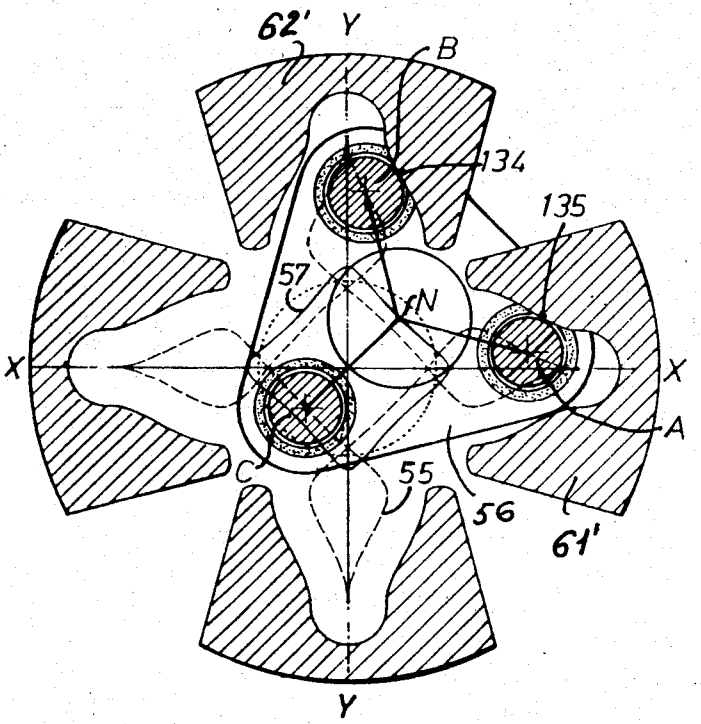
Figure 25:
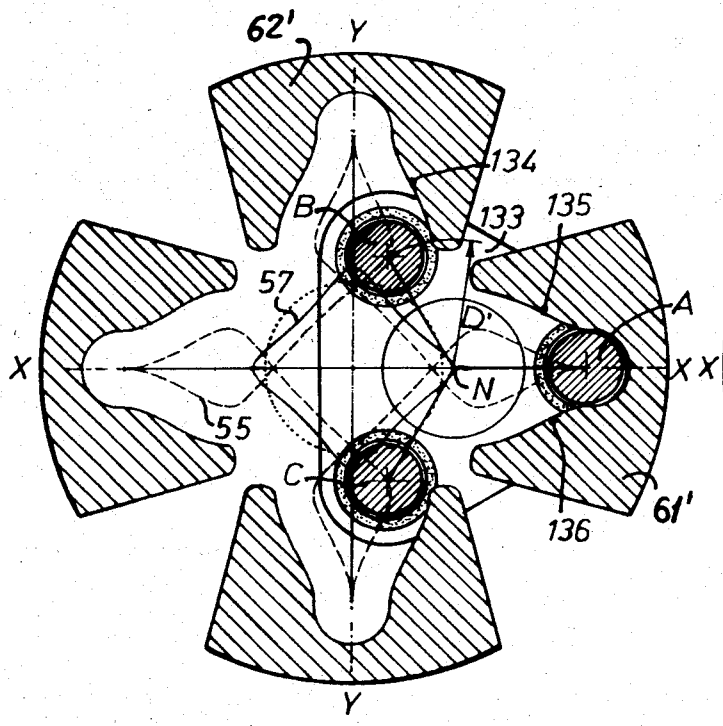

FIGS. 25 and 26 represent the forks 61′–64′ and the curves 52, 55 and 57 of FIG. 20. The graphics and elements in FIGS. 25 and 26 have been designated by the same letters and numbers used in FIG. 20. In FIGS. 25 and 26 there has been included the driven triangle 56 with its three pins A, B and C as mounted on bearings. The triangle is shown in two positions of work; in FIG. 25 in the position when $\psi=0°$, and in FIG. 26 when $\psi=45°$. In these figures, the center N of the triangle 56 is made to run over the hypocycloid 57 by means of the general equations:

$$X=R \cos \psi+\cos 3\psi$$

$$Y=R \sin \psi-r \sin 3\psi$$

but the geometric center of each pin, in order for $\beta$ to have a uniform displacement, must of necessity follow curve 55 as given by the following aforementioned equations:

$$X=R \cos \psi+r \cos 3\psi+D' \cos (360-\psi/3)$$

$$Y=R \sin \psi-r \sin 3\psi+D' \sin (360-\psi/3)$$

To that end, the rotation of the triangle 56 has to be governed by forks 61′–64′, the profile of which is equal to the path of the tangent points generated in given positions by the diameter of the pins as the geometric centers of these pins describe said curve 55.

In FIG. 25 we see that the rotation of the triangle is controlled by pin A as pins C and B have no contact with their corresponding forks. We see that the initial displacement of pin A is a straight line and therefore the walls of fork 61′ will be parallel over that short section, but at the very time when said pin A leaves this parallelism, pin B comes into contact with wall 134 and pin A loses contact with wall 136 but maintains its contact with wall 135. Thus, in any intermediate position in which a pin is not in any one of the straight sections of curve 55, as the one in FIG. 26, when triangle 56 pivots about point N, the rotation in the clockwise direction will be controlled by pin B engaging wall 134, and the rotation in the counterclockwise direction will be controlled by pin A engaging wall 135.

The general displacement of the triangle 56 in FIGS. 25–26 is similar to the one described in FIGS. 21–24 so that the explanation will not be repeated.

Figure 27:
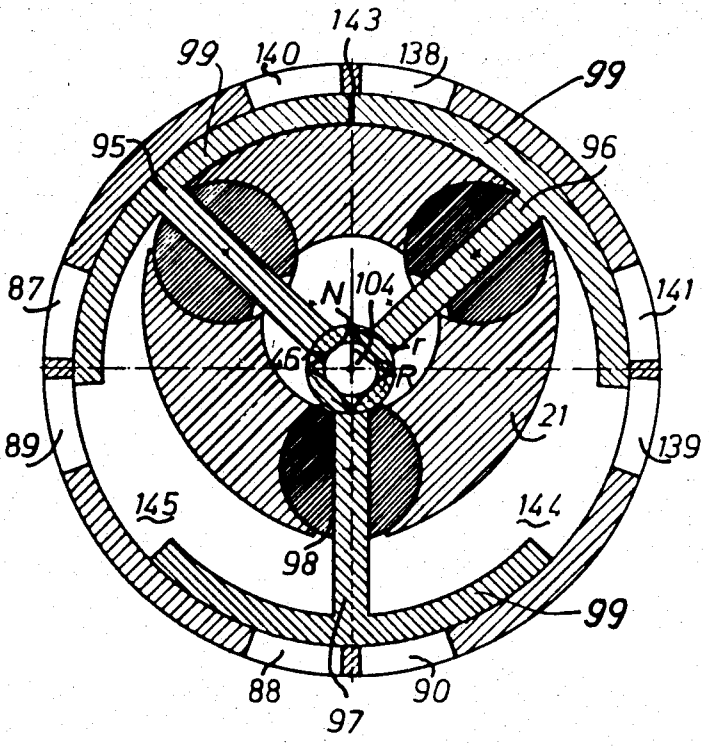

In FIG. 27 there is illustrated the fact that the two arms of the two eccentricities $R=\theta_1$ and $r=\theta_3$ are aligned, being added to each other, as a result of which the center N of the drum will be at the upper point of the hypocycloid 46 and, in that position, there is formed along that alignment only a small chamber.

There is also illustrated in FIG. 27 that the arc which the periphery of the drum forms between vanes 95 and 96, the closing devices 99 of which almost touch each other, does not have as its center of curvature the center N of the drum itself, but rather said center of curvature has been displaced to the geometric center (i.e. axis) of shaft 104 which rotatably supports the vanes. With this same displacement or radius, there are completed the arcs which determine the perimeter of the drum 21. We also see that the radius of the arc which determines the perimeter of the drum 21 is practically equal to the inside radius of the circular ring sectors 99, normally called closing devices, or practically equal to the internal wall of the cylinder 82 (FIG. 35) if the vanes are not provided with closing devices. With the arrangement in FIG. 27, we see that chamber 143 practically does not exist, its volume being reduced to practically zero. In that position, chamber 144 is in its intake phase through port 139, and chamber 145 is in its exhaust phase through port 89.

Figure 28:
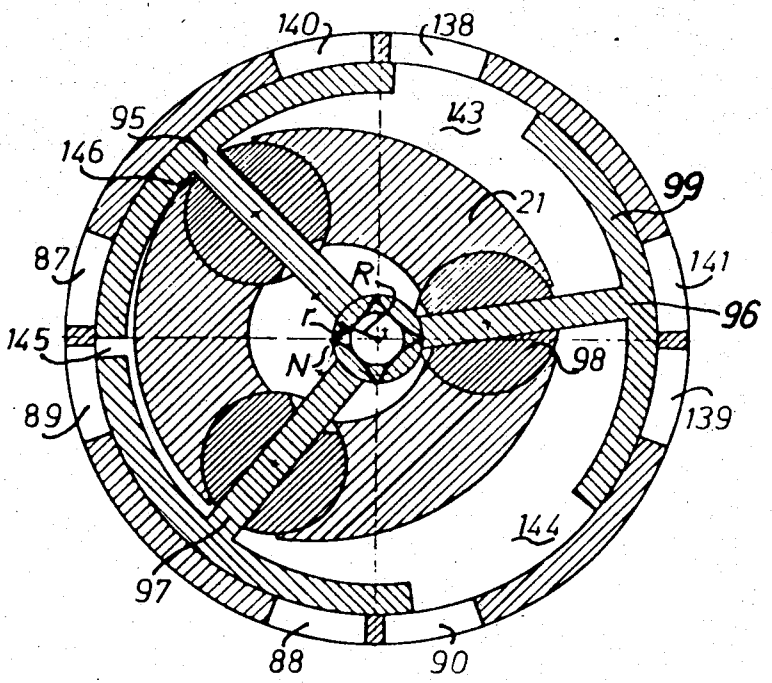
FIGS. 27 through 30 are radial sections which illustrate various rotational positions of the drum.

In the position represented in FIG. 28, the driving shaft has performed a rotation $\psi$ of 22°30′ relative to the position in FIG. 27, and drum 21 will have performed a rotation $\beta$, in the direction opposite that of the output shaft, through an angle which is $\psi/3$. All of this occurs while the geometric center N of drum 21 is running over the second quadrant of the hypocycloid 46.

In the position of FIG. 28, chamber 143 is in its intake or admission phase through port 138, chamber 144 is in its expulsion or exhaust phase through port 90, and chamber 145 has completed the expulsion through port 89. In chamber 145, drum 21 is almost, but not quite, touching the closing device 99 of vane 95 at point 146. This positional arrangement would not happen with the displaced radius at the periphery of the drum if the geometric center of the drum were running over a circle instead of over the hypocycloid 46 with four points, since rotation of the drum over a circle would cause it to become stuck at point 146 on the closing device (or on the internal wall of cylinder 82 in the embodiment of FIG. 35), thus making impossible the functioning of the machine. This fact is of importance since it constitutes the main drawback which prevents the formation of chambers having a practically null volume in machines wherein the drum rotates on a circular orbit.

Figure 29:
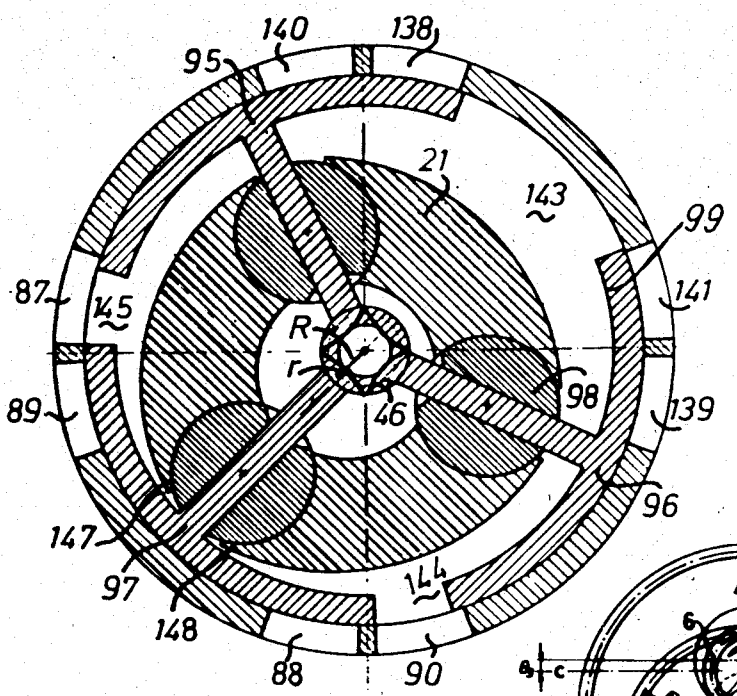

In the same manner, it would be impossible, using a circular orbit, to have the machine operate at points 147 and 148 in FIG. 29. However, such operation is perfectly possible when using the hypocycloid 46 because, as shown in FIG. 29, the radii $R=\theta_1$ and $r=\theta_3$ in this alignment are subtracted and thus separate the drum 21 from the closing devices 99 at points 147 and 148. In this position, chamber 143 ends its intake or admission phase and starts its expulsion phase. Chamber 144 is in its expulsion phase and chamber 145 is in its intake or admission period.

Figure 30:
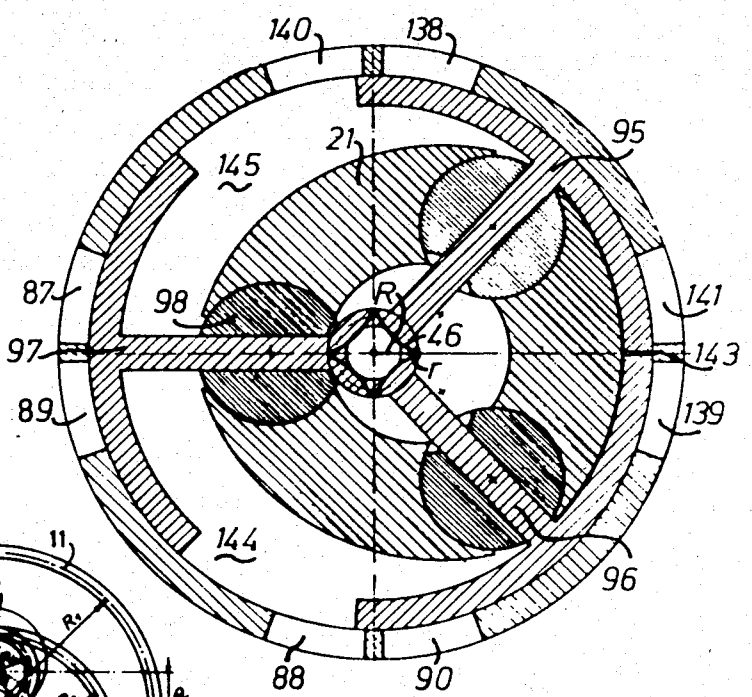

FIG. 30 corresponds to FIG. 27 except that the drum 21 has rotated through an angle $\beta=90°$, and again there is produced a chamber 143 of a volume which is practically zero. That is, the same chamber 143 will present a volume which is null in each quadrant or, said in other words, for each 90° of revolution of $\beta$. But, as there are three chambers which fulfill the same function and at the same location, there will be twelve cycles which the machine will produce for each complete revolution $\beta$ of the drum 21, or four cycles for each rotation $\psi$ of the motor or driving shaft.

In the description of the eccentricities and of their radii in the present invention, there has been used the same types of notation as in U.S. Pat. No. 4,314,533 in order to better compare the main differences.

In U.S. Pat. No. 4,314,533, there is indicated a movement of the center of the drum, which movement does not describe a circle but rather an ellipse, said ellipse being a particular case of hypocycloid.

The main difference in comparison with the present invention is that, in said mentioned U.S. patent, the eccentricities $R=\theta_1$ and $r=\theta_3$ are added at each 180° and are subtracted at each 180° of rotation of the drum, with a dephasing of 90°, while in the present invention the eccentricities $R=\theta_1$ and $r=\theta_3$ are added at each 90° and are subtracted at each 90° of rotation of the drum, with a dephasing of 45°.

The above has as a consequence that, in the position in FIG. 27, when the two eccentricities $R=\theta_1$ and $r=\theta_3$ are added, in the U.S. patent as well as in the present invention, there is obtained in that position a chamber which is practically zero. But when the drum rotates by 90° in the U.S. patent, the eccentricities $R=\theta_1$ and $r=\theta_3$ are subtracted from each other and produce a chamber of appreciable volume; while in the present invention, the eccentricities $R=_1$ and $r=\theta_3$ are again added, causing another chamber the volume of which is practically zero, something which is an indispensable condition for the production of twelve equal cycles at the same locations during each 360° of rotation of drum 21.

Figure 31:
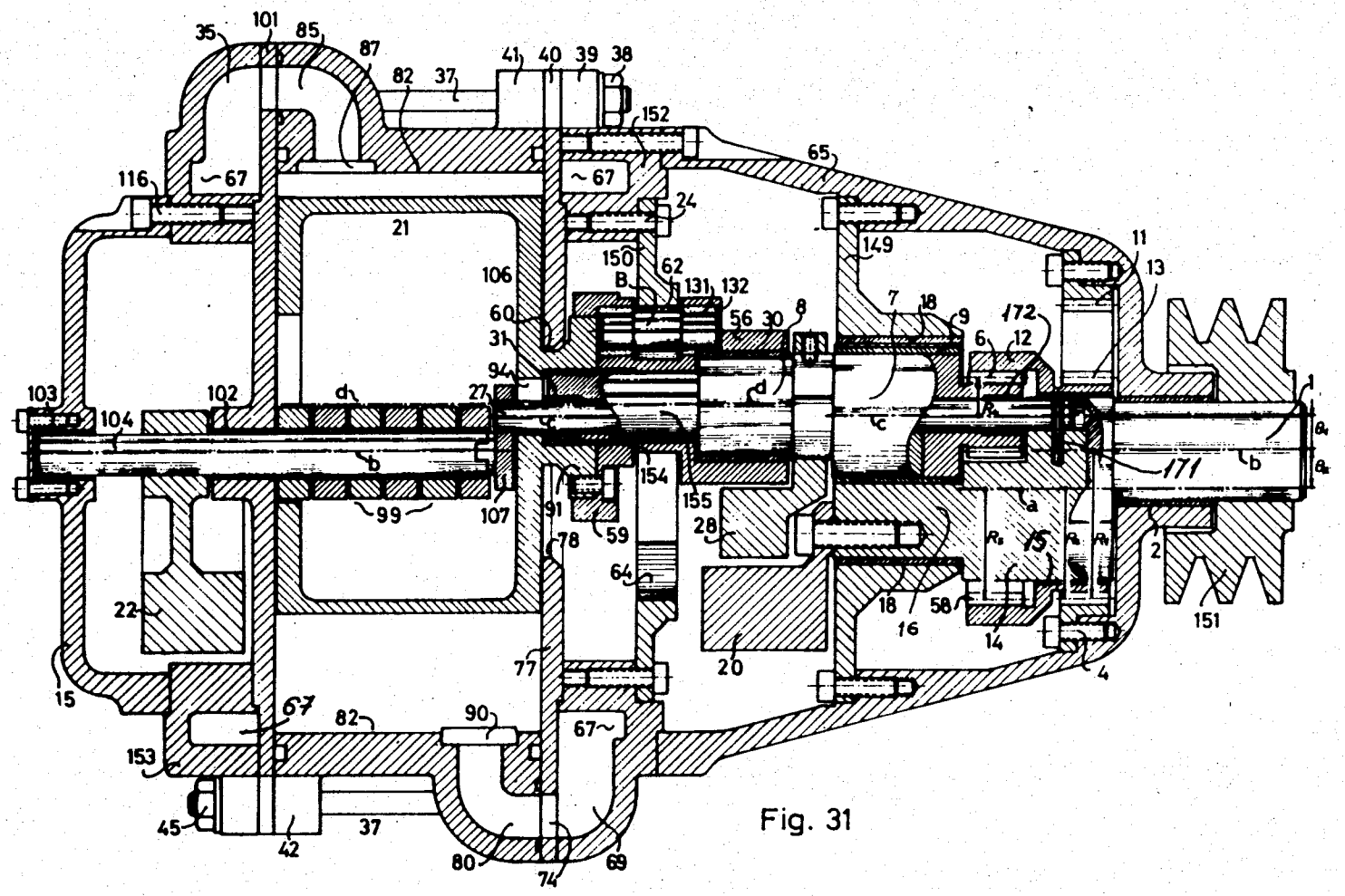
FIG. 31 is a longitudinal sectional view of the motor.

FIG. 31 represents an axial section of an engine similar to the one represented in FIGS. 1 to 17, and the parts thereof have been designated with the same letters and numbers. This axial section cuts through the axes of the three eccentricities $\theta_1$, $\theta_2$ and $\theta_3$. In the illustrated position, $R=\theta_1$ and $r=\theta_3$ are added, which means that the geometric center of the drum 21 will be at one point of the hypocycloid.

In the position of FIG. 31, the exposed sections of cylinder 82 and drum 21 do not correspond to the real position in which they ought to be cut, but parts have been arranged so that there might be seen the intake elbows 35 and 85 with their port 87, which correspond to the collector side 153, and elbows 69 and 80 with their port 90, which correspond to the collector side 152.

In FIG. 31, the only part of the vanes which has been represented is their rings 99, and the only part represented of drum 21 is its perimeter wall, there having been indicated neither the swivel joints nor the embossments which may exist. The space which remains in the upper part, between drum 21 and cylinder 82, would be occupied by the closing devices on the vanes, but they have been deleted for clarity of illustration.

Figure 33:
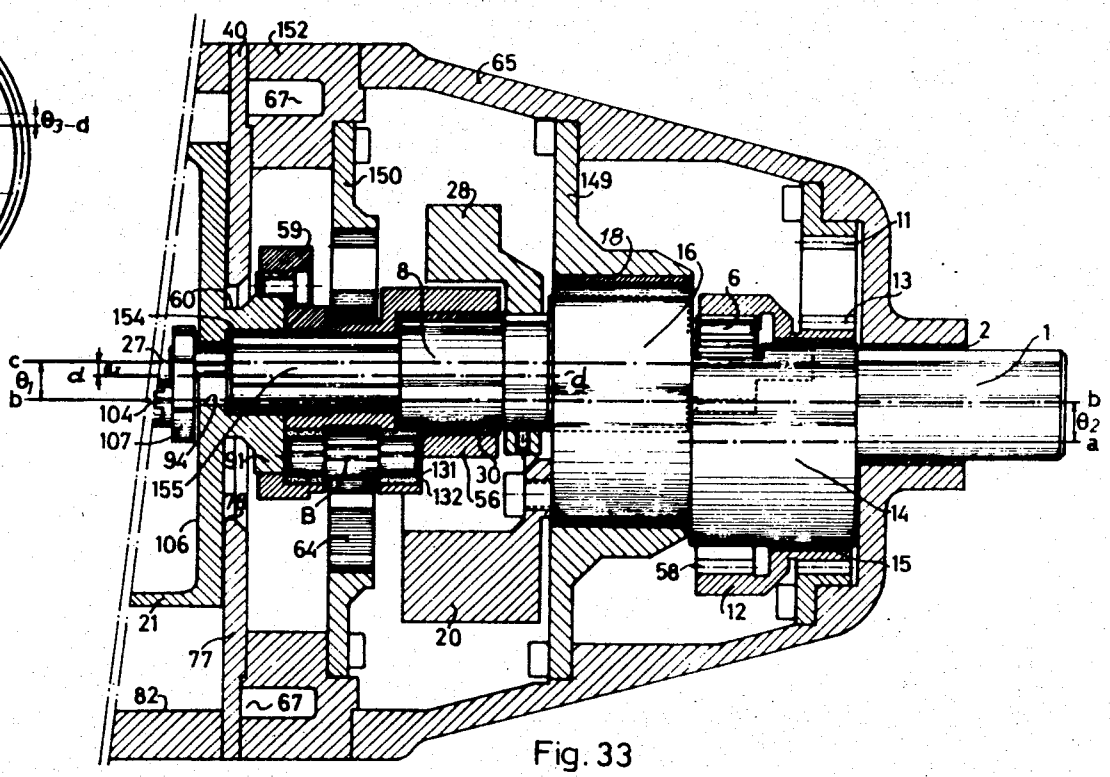
FIGS. 33 and 34 respectively correspond to FIGS. 31 and 32 but show the motor in a different position.

There can be seen in FIGS. 31 and 33 the crankshaft schematically comprising the output shaft 1, the axis of which is "b", the eccentric 14 with its geometric axis "a" and the eccentric radius of which, with respect to "b", is equal to $\theta_2$, and shaft 16 which is concentric with "b" and therefore concentric with shaft 1. This crankshaft forms a single rigid body. Said crankshaft 1, 14, 16 is rotatably supported by the bearings 2 and 18.

The arm of the crankshaft, namely the shaft 27, is fastened to the crank by means of pin 171 (FIG. 31), as a result of which the shaft 27 performs a circular orbit 52 (FIGS. 19, 21, 22, 23, 24, 32 and 34) with $R=\theta_1$ as the crankshaft rotates. Around shaft 27 there rotates the train of the second eccentricity, schematically comprising pinion 6, shaft 8 and shaft 155, the whole forming a single rigid body. Pinion 6 and shaft 7 are concentric with shaft 27 about the axis "c", but shaft 8 and shaft 155 are concentric with respect to each other about a geometric axis "d", and are not concentric with respect to pinion 6 and shaft 7, their axes "d" and "c" being parallel but spaced apart by the distance $r=\theta_3$.

The train 6, 7, 8, 155 is located on the arm 27 of the crankshaft and rotates around arm 27 by means of bearings 31 and 172. Concentrically with that rotation, and on its external side, shaft 7 is directly rotatably supported on the shaft 16 by means of bearing 9.

On eccentric 14 (FIGS. 31 and 33), the geometric axis of which is "a", there rotates by means of bearing 15 the ring 12 having internal teeth 58 and external teeth 13. The internal teeth 58 engage the pinion 6, and the external teeth 13 engage the internal teeth of a ring 11 which is concentric with the shaft 1 and 16 and which is rigidly fixed to housing 65 by means of screws.

Figure 32:
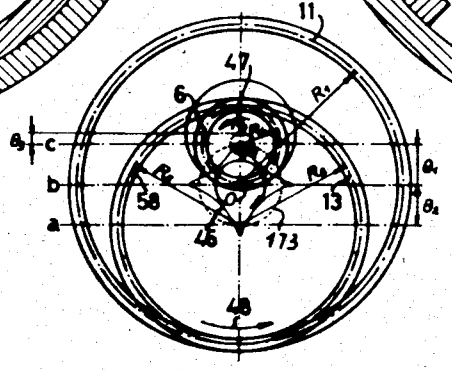
FIG. 32 illustrates the gear and radius relationships thereof.
Figure 34:
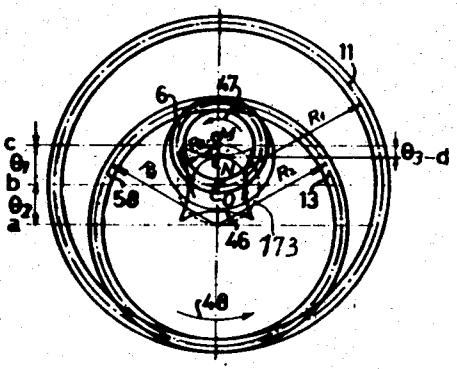

When the crankshaft rotates on its geometric axis "b", the geometric axis "a" (which is also the axis of ring 12) describes a circular orbit 173 with an eccentricity designated by $\theta_2$ in FIGS. 32 and 34, which forces the internal teeth of static ring 11 to engage in a non-interrupted manner with the external teeth 13 of ring 12, imparting to said ring 12 a rotation in the direction opposite to that of its orbit.

In U.S. Pat. No. 4,314,533, there are represented two versions of double eccentricity: a simple one and a compound one with an intermediate orbital ring.

The simple or direct one can not be applied in this invention because the diameter of the pinion in this simple train would be excessively out of proportion in the negative sense relative to the force to which it would have to be subjected. For that reason, the innovations apply only to the compound crankshaft which is described in the present specification with the same numbers and letters as in said U.S. patent, so that it is possible to distinguish and clarify the innovations.

In the specification herein presented, there have been developed all of the equations on the data known for construction: R and r, and the angle $\psi$ which is the angle of rotation of the driving shaft 1, R being equal to $\theta_1$ and r being equal to $\theta_3$.

In this new system, in order to obtain twelve equal cycles with a zero chamber, it is indispensable for the geometric center of drum 21 to describe a four point hypocycloid, according to the equations given for the axes of abscissa and ordinate which are:

$$X=\theta_1 \cos \psi+\theta_3 \sin 3\psi.$$

$$Y=\theta_1 \sin \psi=\theta_3 \sin 3\psi.$$

In the cited U.S. patent, this displacement (movement) is not achieved, and the engagement which determines the rotation of the drum is not possible for the reasons already explained. In order for the displacement of the drum to possibly occur, there must be verified (FIGS. 32 and 34) that:

$$R_2 = \frac{R_3 \cdot \theta_2}{4 \cdot R_4 - R_3}$$

it being recommended to have $R_3=3R_4$ in order for the proportions to be more rational and not to have to reduce the diameter of some of the shafts.

Observing FIG. 31, we see in the train driven by pinion 6 concentric with shaft 7, and starting from the latter, the shafts 8 and 155 are not concentric with "c" but have a parallel displacement "d", this radial separation being the radius r of the second eccentricity $\theta_3$.

We also observe that drum 21 is coaxially aligned with driven triangle 56 and both are joined together by securing hub 59 to plate 91 by means of screws. This rigid assembly of drum 21 and driven triangle 56 rotates freely about axis "d" of shafts 8 and 155 by means of bearings 30 and 154. Shaft 155 has a smaller diameter than shaft 8 because of space, as it must be lengthened to prevent drum 21 from tipping.

Pins A, B and C, of which only pin B can be seen in FIGS. 31 and 33, serve to control the rotation of the drum triangle assembly about axis "d". In FIG. 31, the pin B is driven by fork 62 and, in the position represented in FIG. 33, that pin is free, even though in this figure the driven pin is not seen in that position because of the sectional cut-line.

One of the objectives of the present invention is to make it possible to balance the rotor system which comprises, as already stated, drum 21 with its swivels 98, its plate 106 and the group of members which form the driven triangle 56.

That rotor system, by its form of construction, has an axis of symmetry "d", FIGS. 31 and 33, and for that reason the mass center of the system will be applied to a point on that axis. But, if we observe the Figures, we see that said axis in addition is its axis of rotation, as a result of which in any angular position $\beta$, the absolute position of its mass center will remain unchangeable on said axis "d".

It has been stated that one of the most important conditions of the present invention is that said axis "d", in its orbital displacement, should describe a hypocycloid 46 as seen in FIG. 18 and as represented in FIGS. 31 and 33. But, as the mass center of the rotor system also has to run over a hypocycloid, the radial distance o of which varies from the center of rotation 0 of FIG. 18 as a function of the angle of rotation $\psi$ of the driving shaft, the rotor system will be subject to accelerations or decelerations which are impossible to compensate for and to balance with the conventional counterweights 20 and 22 seen in FIGS. 3, 14, 31 and 33, which are imparted only with a circular motion.

In order to overcome this difficulty in balance, there has been provided in this class of machine a compensating counterweight endowed with a hypocycloid motion, the mass of which adds to that of the rotor system, causing it to vary its center of mass from axis "d" which describes a hypocycloid without the compensating counterweight, to axis "c" when these two masses are added together. Said axis "c" is the arm of the first eccentricity $\theta_1=R$, and since, as already seen, it does not describe a hypocycloid but a circle 52 (FIG. 18), it is thus possible in this manner to achieve a balance with the conventional counterweights 20 and 22. The assembly of the balancing counterweight in order for it to displace the center of gravity or mass of the rotor system may be achieved in several ways, and the one which is explained below is given as a representative one.

In FIG. 31 it is seen that the compensating counterweight 28 is rigidly mounted by means of screws or bolts on the eccentric 8 of the train of the second eccentricity as driven by pinion 6, in a manner such that it is diametrically opposed to arm r. But, as in that position represented in FIG. 31, the two arms R of the first eccentricity and r of the second one are added, the compensating element 28 is lined up in a direction opposite that of "c"-"d", which is the arm of the second eccentricity, and therefore it remains on the same side as the conventional counterweights 20 and 22.

In order to clarify this concept, we shall imagine the mass centers of the rotor and of the compensating unit 28 moving separately in FIG. 18.

FIG. 31 is a section in FIG. 18 along line OY', where R=Oh and r=hg are added, as a result of which the mass center of the rotor system will be located at point g which is R+r=Oh+hg. But if we observe FIG. 31, we see that compensating device 28 is in the lower part so that the mass center of the compensating device 28 will be located at point W on the lower part of the ordinate axis OY', the distance of which WO+Oh will be inversely proportional to the mass of the compensating device 28.

In said FIG. 18, the center of gravity of the rotor system, such as has been described, passes through point "g", and its arm is gh=r.

In order for the mass center to pass from point g to point h, there must be verified that the product of the mass m of the rotor system multiplied by its arm, which always will be: $r=\theta_3=gh$, will be equal to the mass m' of compensating unit 28 times the distance from its center of application W to point h, since point h is the center of rotation "c" represented in FIGS. 31 and 33 for the rotor system as well as for the compensating unit 28. That is, in order for the mass center to be located at point h pertaining to circle 52, there will have to be verified that $$m \times r = m' \times Wh.$$

FIG. 33 is a section along line OK in FIG. 18, where R=Oj, and r=jf are subtracted, as a result of which the mass center of the rotor system will be located at point f which is R−r=Oj−jf. But if we observe FIG. 33, we see that compensating unit 28 will be located at point W' on the upper part of line OK. In FIG. 18, the mass center passes through point f and its arm is jf=r. In order for the mass center to pass from point f to point j, there must also be verified that $$m \times r = m' \times Wj.$$

This equation is equal to the one given for FIG. 31 when the two eccentricities were added because the mass of the rotor system is the same, its arm r is the same and is equal to $\theta_3$, the mass m' of the compensating unit is also the same one, and the distance from circle 52, which is the trajectory of axis d in FIG. 31 to its point of application W', is also the same one. If all of the factors are equal, the product will also be the same, so that the mass center in that position will be at point j, but as point j (just as point h) is located on circle 52 with a radius R $\theta_1$, in any position the rotor system happens to be with its added compensating unit, its mass center will always have the same radius which will be $R=\theta_1$.

Once the mass unit center is forced to describe a circle, same can easily be balanced by the counterweights 20 and 22 describing a circular orbit. That mass center describes a circle which will be circle 52 in FIG. 18.

Compensating unit 28 must be located on both axial sides of the drum 21 in order to be perfectly balanced, said mass being proportionally distributed. But, as the value of $\theta_3$, which is the radius which is added to and subtracted from $\theta_1$ to produce the hypocycloid, is relatively small relative to $\theta_1$, the kinematic complication it represents is not worthwhile so that the small swaying which occurs is absorbed by the conventional counterweights 20 and 22 located on both sides of the rotor system.

Figures 35, 36, 37:
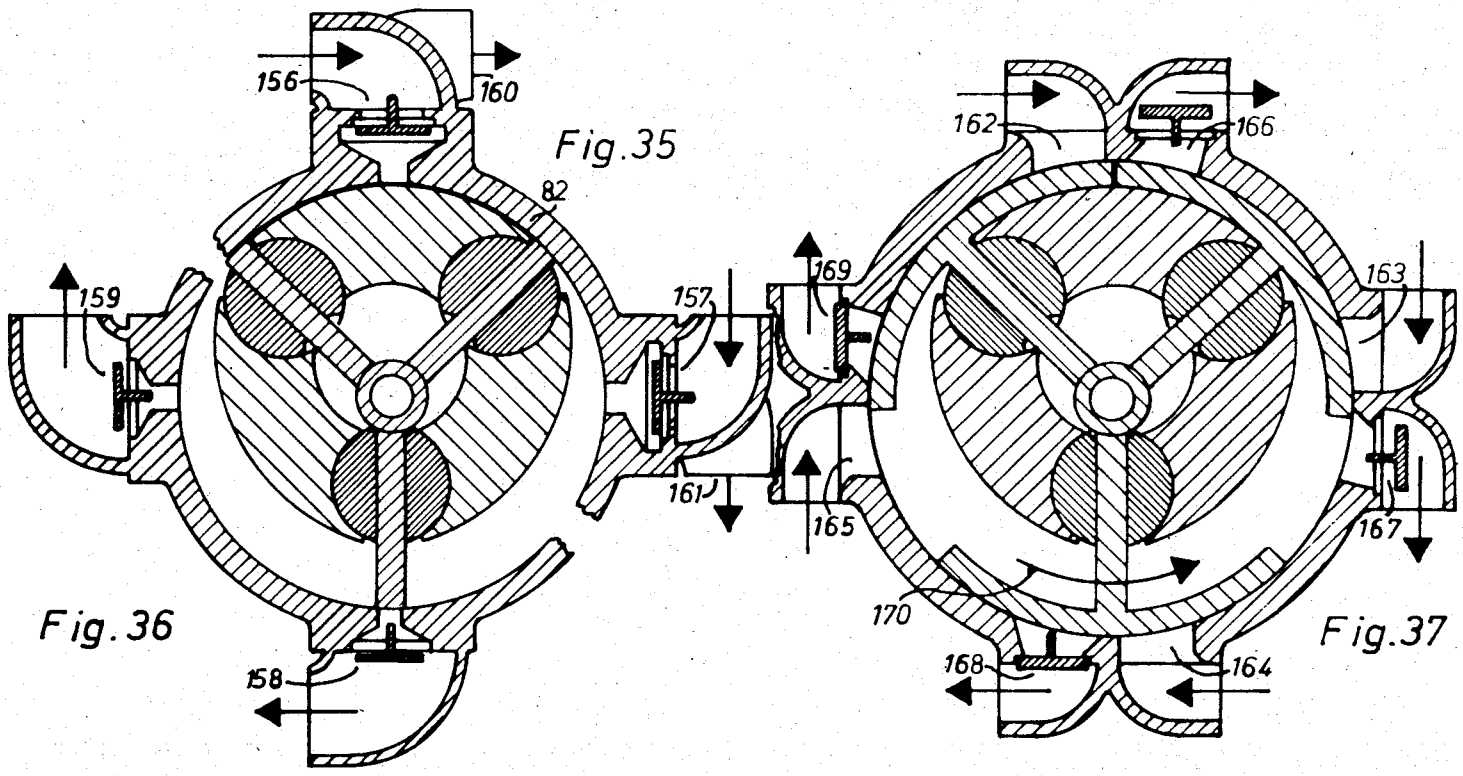
FIGS. 35 through 37 are radial sections which illustrate the rotor and the intake and/or exhaust valves.

In FIGS. 35 and 36 there is represented a compressor similar to the machine presented above, which compressor is provided with three vanes, but these vanes do not have closing devices. As a result, the valve function must be performed by means of two automatic valves in each quadrant, one for the intake and one for the expulsion or discharge, which are axially lined up but located in different radial planes.

FIG. 35 represents a radial section through the intake valves and illustrates that the upper chamber which the drum forms between two vanes and the cylinder is practically null.

FIG. 36 is a radial section through the expulsion or discharge valves, as located in a different radial plant from the one of the intake valves.

The direction of rotation of the rotor system exerts no influence on the functioning, since it works in exactly the same manner in both directions, whatever may be the direction of rotation. The fluid always enters through the intake conduits 156 and 157 and is always expulsed or discharged through discharge conduits 158 and 159, and two additional intake and exhaust conduits which are not shown in FIGS. 35–36.

In FIG. 37, there is represented a compressor having only one discharge valve 166, 167, 168 and 169 in each quadrant, with the intake through the ports 162, 163, 164 and 165 being controlled by means of the closing devices on the vanes in a manner similar to the machine described in FIGS. 27–30. This figure illustrates that the minimum upper chamber has an approximately null volume, the same as in FIG. 35.

Those compressors of FIGS. 35–37 are similar, with respect to their valve location, to those in Spanish Pat. No. 432 981, but with the peculiarity that they are endowed with the mechanisms explained in the present invention so that there can be obtained, when a minimum chamber is formed, a volume which is practically zero. This thus creates an extraordinary compression ratio, something which appreciably improves the volumetric and energetic efficiency, as already explained, and which constitutes the main object of the present invention.

While the present specification and figures illustrate machines having a single rotor body, it will be recognized that additional rotor bodies can be added by means of a common shaft, adjusted with angles suitable among themselves.

In the present description, there have not been specified the systems for lubrication, refrigeration, closing devices, bearings and other complementary members as those which can be applied are numerous and produce no essential change in the improvements.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a rotary fluid-handling apparatus including a substantially cylindrical housing, a rotor positioned within said cylindrical housing and supported for rotational and orbital movement relative thereto, the rotor including a cylinderlike drum having three blade-like vanes projecting radially outwardly therefrom for cooperative engagement with an interior annular wall defined by said cylindrical housing, and a rotatable crank mechanism interconnected to the drum for causing the central longitudinal axis of the drum to undergo an orbital motion relative to the cylindrical housing which describes a hypocycloidal path, the crank mechanism including a first crankshaft rotatable about a first axis which is aligned with the axis of the cylindrical housing, the first crankshaft having a first eccentric crank nonrotatably secured thereto for orbiting rotational movement about said first axis, said first crank defining a second axis which is parallel to but eccentrically displaced from said first axis, said crank mechanism including a second crankshaft which is rotatably supported on said first crank for rotation about said second axis, said second crankshaft having a second eccentric crank nonrotatably secured thereto and defining a third axis which is parallel to but eccentrically displaced from both of said first and second axes, said drum being disposed with its central axis aligned with said third axis, the improvement comprising control means connecting between said drum and said housing for causing the hypocycloidal orbital path of the central axis to define the shape of a four-pointed star, said control means including three control pins which are fixed relative to said drum and project axially, said control pins being disposed in spaced relationship so that they define the points of an equilateral triangle which has its center located on said central axis, and said control means also including four control forks which are fixed relative to the cylindrical housing and are uniformly angularly spaced around said first axis, each said control fork defining a slot which projects radially relative to said first axis and opens radially inwardly, each said slot being defined between a pair of opposed walls which guidingly cooperate with one of said pins during the orbital and rotational movement of the drum for guiding the radial movement of the pin outwardly and inwardly of the respective control fork.

2. A rotary apparatus according to claim 1, including a first set of four intake ports associated with said cylindrical housing and opening into the interior thereof in uniformly angularly spaced relationship therearound for supplying fluid thereto, and a second set of four exhaust ports associated with said cylindrical housing and opening inwardly thereof and being uniformly angularly spaced therearound for permitting the exhausting of fluid therefrom, said exhaust ports being angularly displaced relative to said intake ports.

3. A rotary apparatus according to claim 1, including gear means cooperating between said first and second crankshafts and said housing for causing said second crankshaft to undergo three absolute revolutions in the opposite direction for each revolution of said first crankshaft.

4. A rotary apparatus according to claim 3, wherein a shaft part extends axially across the cylindrical chamber defined by said cylindrical housing, said shaft part being aligned with said first axis, said vanes having the radially inner ends thereof rotatably supported on said shaft part, said drum being formed by three arcuate sectors which are individually positioned between and adjacent an angularly-spaced pair of said vanes, each said arcuate sector having a peripheral surface of a cylindrical configuration as it extends angularly between an adjacent pair of said vanes, said peripheral surface being generated about a radius which substantially exceeds the radial spacing from said peripheral surface to said central axis, said lastmentioned radius being substantially equal to the radius of said cylindrical chamber or slightly less than the chamber radius when the blades are provided with arcuate closing devices on the radially outer ends thereof.

5. Improvements in a rotating pneumatic machine including a static cylinder which is fitted with two lateral walls in the manner of covers which close the cylinder on both sides and provided with central openings which permit the exit of at least one hub which carries a drum, the hub being located on one side of and coaxial with the drum which is essentially cylindrical in shape, said drum being subject to a first movement which rotates the drum around its geometric axis and to a second movement which orbits the drum inside the cylinder, said drum having three axial-extending slot-like openings angularly separated by substantially 120°, vanes placed in said openings and projecting outwardly of the drum, the vanes being articulated by means of rings and in the manner of hinges around a common shaft located inside the drum, said common shaft remaining in a position which is separated, in a parallel manner, from the geometric axis of said drum, said common shaft for the vanes being the geometric center of the cylinder so that said vanes are radii of the cylinder, the vanes at their radially outer ends having a sliding fit against the internal wall of said cylinder and also fitting at their axial ends against the covers, the vanes fitting within the axial openings of the drum by means of swivels which let said vanes slide among them and which in addition let them vary their relative angles among themselves, said swivels essentially being cylindrical segments which by their flat part fit with the vanes and by their cylindrical part fit with the axial openings of the drum which present the same cylindrical profile so that they can fit with said swivels, said drum being mounted on an eccentric arm of a second crankshaft which functions as a second eccentricity which is composed of a train formed by a pinion of radius $R_4$ and a shaft concentric with said pinion, said eccentric arm being fixed to the last-mentioned shaft and having an eccentricity $\theta_3$ relative to the axis of rotation of said pinion, said second crankshaft being rotatably supported on a bearing positioned on a first crankshaft for rotation about the central axis of the pinion, said first crankshaft rotating about an axis of rotation which is parallel to but radially spaced from the pinion axis by a first eccentricity of value $\theta_1$, the two eccentricities being synchronized by means of an orbital ring fitted with both an internal set of teeth of radius $R_3$ which is meshingly engaged with the pinion and an external set of teeth of radius $R_2$ which is meshingly engaged with internal teeth of radius $R_1$ on a static ring which is concentric with the axis of the first crankshaft, said orbit ring rotating and orbiting around a shaft part which is fixed to said first crankshaft and whose axis has a second eccentricity $\theta_2$ relative to the axis of said first crankshaft and in a radial direction opposite that of the first eccentricity, the orbit ring having an engaging ratio such that each rotation of the first crankshaft causes four rotations of the second crankshaft about its pinion axis but in the reverse direction, a variable chamber being formed in the ring-shaped space which is found between the peripheries of the drum and the cylinder as limited by two adjacent vanes, and means for permitting fluid to be supplied to or discharged from the variable chambers, comprising the improvement wherein a mechanism consisting of four static control forks cooperate with a driven triangle unit which is coaxially fixed to the drum to cause the drum to rotate with a controlled velocity, said drum rotating in a direction opposite that of its orbit with an average angular velocity which is one third that of the first crankshaft for each rotation of same, the geometric center of the drum being forced, by an engaging relationship between the forks and triangle unit, to move along a path defined by the equations $$X+\theta_1 \cos \psi+\theta_3 \cos 3\psi$$

$$Y=\theta_1 \sin \psi-\theta_3 \sin 3\psi,$$

which are the equations of a four-pointed star-shaped hypocycloid with four symmetrical sides, $\psi$ being the angle of rotation of the first crankshaft, whereby as the center of the drum passes by each one of the four points of that hypocycloid, there results in a minimum volume of each one of the three chambers which is practically null when the corresponding chamber is lined up with that point of the hypocycloid.

6. An improvement according to claim 5, wherein the triangle unit is made of a plate structure fitted with three pins directed parallel to the axis of rotation and each fitted on the plate structure by a bearing which permits its rotation, the three pins being located at the vertexes of an equilateral triangle.

7. An improvement according to claim 6, wherein the distance D which exists from the geometric center of each pin to the geometric center of the equilateral triangle which they define, when the angular velocity $\beta$ of the triangle unit is not uniform but controlled, is equal to:

$$D = \frac{(\theta_1 - \theta_3) \sin 45°}{\sin 15°}.$$

8. An improvement according to claim 6, wherein D' represents the distance from the geometric center of each pin to the geometric center of the equilateral triangle which they determine, when the angular velocity $\beta$ of the triangle unit is uniform, said distance D' not being an exact measurement, but in order for the trajectory of the three pins not to describe an open loop and to prevent the oscillating play which such would cause on the triangle unit and the drum, the distance D' must be equal to or very close to $1.5\times\theta_1$.

9. Improvements according to claim 5, wherein in the same radial plane as the pins there are provided the four forks, the forks being identical and angularly spaced apart by 90° in concentric and surrounding relationship to the first crankshaft, said forks being rigidly affixed to the housing, the forks having a surface with a profile generated by contact with the periphery of the pin when the geometric center of the triangle unit moves over said hypocycloid, the profiles on the forks controlling the accelerations of the drum-triangle unit in differential sections of its rotation.

10. Improvements according to claim 9, wherein the profile of the four forks, when they control the driven triangle unit for uniform velocity $\beta$, is generated by the tangent to the periphery of the pins at specific positions of their trajectory, and the geometric center of the pins describe a curve which is given by the equations:

$$X=\theta_1 \cos \psi+\theta_3 \cos 3\psi+D' (360-\psi/3)$$

$$Y=\theta_1 \sin \psi-\theta_3 \sin 3\psi+D' (360-\psi/3).$$

11. Improvements according to claim 7, wherein the profile of the forks, in the case when they are to transmit to the drum a controlled velocity $\beta$ for a rotation $\psi$ from 0° to 45°

$$\beta = \text{arc sin} \frac{\theta_1 \sin \psi - \theta_3 \sin 3\psi}{D}$$

and for a rotation $\psi$ from 45° to 90°

$$\beta = 30 - \text{arc sin} \frac{\theta_1 \cos \psi + \theta_3 \cos 3\psi}{D}$$

the profile of the forks must have faces which are parallel with a separation between these parallel faces equal to the diameter of the pins, the parallel faces being radially spaced from the motor shaft by a distance having a minimum distance P between said motor shaft and the beginning of the parallelism in each fork, said P being defined by:

$$P = (\theta_1 - \theta_3)\left(1 + \frac{\sin 75°}{\sin 15°}\right) \cos 45°$$

and a maximum distance L through which the pins travel, with L being defined by:

$$L=\theta_1+\theta_3 D+t$$

with t being the set tolerance at the end of the trajectory.

12. Improvements according to claim 5, wherein in order for the geometric center of the driven triangle unit jointly with the drum to describe a hypocycloid with four points, it is necessary that for each rotation of the first crankshaft the second crankshaft must perform three absolute rotations and in a direction which is opposite, or four rotations relative among themselves, and in order for that to take place the engaging ratio between the pinion of the second crankshaft, the original radius of which is $R_4$, and the internal teeth of radius $R_3$ of the orbital ring and in its turn with its external teeth of radius $R_2$ which engages the teeth of radius $R_1$ of the static ring, said engaging ratio must follow the equation below:

$$R_2 = \frac{R_3 \cdot \theta_2}{4R_4 - R_3}.$$

13. Improvements according to claim 5, wherein the train of the second eccentricity is rotatably supported on a shaft which runs through its geometric center, said last-mentioned shaft being rigidly assembled by means of a pin or other similar means to said first crankshaft, said shaft being axially aligned with the arm of the first eccentricity, said shaft transmitting the rotation of the first crankshaft to the opposite axial side of the drum to locate on that side a counterweight for dynamic equilibrium.

14. Improvements according to claim 13, wherein, in order to balance the rotor system when its mass center describes a hypocycloid, the system is provided with a compensating counterweight which also describes a hypocycloid and, when adding the mass of the rotor system with the mass of the compensating counterweight, there is caused a constant variation of the resultant mass center such that it runs along a circle.

15. Improvements according to claim 14, wherein the compensating counterweight is mounted in a rigid manner on the train of the second eccentricity, remaining in a position opposite to its arm, the product of its mass times its arm, which is the distance from the mass center to the center of rotation of the drum, being equal to the mass of the rotor system times its arm $\theta_3$.

16. Improvements according to claim 5, wherein each one of three equal arcs which form the perimeter of the drum between two vanes has the center of its arc located at a distance from the geometric center of the drum, and in a direction opposite to its arc, which is $\theta_3+\theta_1$ plus tolerances, the radius of each one of those three arcs, in order to make it possible for each one of the chambers to have a volume which is practically null when they present their minimum volume, being equal to the radius of the cylinder when there are no closing devices and the same radius minus the thickness of the closing devices when the latter are present, subtracting in both cases the tolerances.

* * * * *

UNITED STATES PATENT AND TRADEMARK OFFICE

CERTIFICATE OF CORRECTION

PATENT NO. : 4 585 404

DATED : April 29, 1986

INVENTOR(S) : Jose' M. B. Barata

It is certified that error appears in the above-identified patent and that said Letters Patent is hereby corrected as shown below:

Column 24, line 2; change "lastmentioned" to ---last-mentioned---.

Column 26, line 32; the formula should read as follows:

$$L = \theta_1 + \theta_3 + D + t$$

Signed and Sealed this

*Twenty-sixth* Day of *August 1986*

[SEAL]

*Attest:*

DONALD J. QUIGG

*Attesting Officer*

*Commissioner of Patents and Trademarks*